US011092129B2

(12) United States Patent
Asakura et al.

(10) Patent No.: US 11,092,129 B2
(45) Date of Patent: Aug. 17, 2021

(54) BARRIER-DISCHARGE-TYPE IGNITION APPARATUS

(71) Applicant: Mitsubishi Electric Corporation, Chiyoda-ku (JP)

(72) Inventors: Ryota Asakura, Chiyoda-ku (JP); Tomokazu Sakashita, Chiyoda-ku (JP); Takahiro Inoue, Chiyoda-ku (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 16/309,621

(22) PCT Filed: Feb. 28, 2017

(86) PCT No.: PCT/JP2017/007622
§ 371 (c)(1),
(2) Date: Dec. 13, 2018

(87) PCT Pub. No.: WO2018/034014
PCT Pub. Date: Feb. 22, 2018

(65) Prior Publication Data

US 2019/0186454 A1 Jun. 20, 2019

(30) Foreign Application Priority Data

Aug. 17, 2016 (JP) ..... JP2016-159816

(51) Int. Cl.
*F02P 3/01* (2006.01)
*F02P 5/15* (2006.01)
*F02P 9/00* (2006.01)

(52) U.S. Cl.
CPC ..... *F02P 3/01* (2013.01); *F02P 5/15* (2013.01); *F02P 9/005* (2013.01); *F02P 9/007* (2013.01)

(58) Field of Classification Search
CPC ..... F02P 3/01; F02P 5/15; F02P 9/005; F02P 9/007
See application file for complete search history.

(56) References Cited

U.S. PATENT DOCUMENTS 6,841,942 B2 * 1/2005 Beckmann ..... H01J 37/321 156/345.34
7,422,664 B2 * 9/2008 Ritchie ..... H01J 37/32009 204/192.12

(Continued)

FOREIGN PATENT DOCUMENTS

JP 2014-224493 A 12/2014
JP 2015-200300 A 11/2015

OTHER PUBLICATIONS

International Search Report dated May 16, 2017, in PCT/JP2017/007622, filed Feb. 28, 2017.

(Continued)

*Primary Examiner* — David Hamaoui
(74) *Attorney, Agent, or Firm* — Xsensus LLP

(57) ABSTRACT

A barrier-discharge-type ignition apparatus that can accurately determine the application voltage, of a barrier ignition plug, that causes a non-ignition discharge to occur. In the barrier-discharge-type ignition apparatus, in a combustion assist control, the voltage difference between the one-period-prior application voltage and the present-period application voltage in the AC period is calculated based on an application voltage detected by a voltage detection circuit; then, it is determined whether or not a discharge exists in the barrier ignition plug, based on the comparison between the voltage difference and a preliminarily set discharge determination threshold value.

11 Claims, 10 Drawing Sheets

(56) References Cited

U.S. PATENT DOCUMENTS

| | | | | |
|---|---|---|---|---|
| 7,625,531 | B1 * | 12/2009 | Coates | F02M 27/042 422/186.04 |
| 8,746,218 | B2 * | 6/2014 | Freen | F02P 23/04 123/623 |
| 8,776,769 | B2 * | 7/2014 | Kajita | F02P 9/007 123/596 |
| 8,800,539 | B2 * | 8/2014 | Toedter | F02P 3/01 123/606 |
| 9,137,885 | B2 * | 9/2015 | Yuzurihara | H05H 1/46 |
| 9,263,857 | B2 * | 2/2016 | Nakayama | H01T 13/40 |
| 9,450,519 | B2 * | 9/2016 | Yuzurihara | H02M 3/1582 |
| 9,484,719 | B2 * | 11/2016 | Zheng | H01T 19/04 |
| 9,699,878 | B2 * | 7/2017 | Yuzurihara | H05H 1/46 |
| 9,709,017 | B2 * | 7/2017 | Hashimoto | F02P 23/045 |
| 9,831,639 | B2 * | 11/2017 | Burrows | H02M 3/00 |
| 10,187,968 | B2 * | 1/2019 | Buchanan | H05H 1/46 |
| 10,290,477 | B2 * | 5/2019 | Gieraltowski | H01J 37/32917 |
| 2009/0151322 | A1 * | 6/2009 | Coates | F02M 27/042 60/275 |
| 2017/0045025 | A1 | 2/2017 | Nakayama et al. | |

OTHER PUBLICATIONS

Chinese Office Action dated Aug. 26, 2020, issued in corresponding Chinese Patent Application No. 201780046970.7.

* cited by examiner

BARRIER-DISCHARGE-TYPE IGNITION APPARATUS

TECHNICAL FIELD

The present disclosure relates to a barrier-discharge-type ignition apparatus that performs ignition through non-equilibrium plasma discharge in a combustion chamber of an internal combustion engine.

BACKGROUND ART

With regard to such a barrier-discharge-type ignition apparatus as described above, an ignition apparatus disclosed in PLT 1 below is known. The ignition apparatus disclosed in PLT 1 includes an ignition plug and a high-frequency power source, which is provided with at least a DC power source, two switching devices, and a voltage boosting transformer, and performs alternate opening/closing driving of the two switching devices so that an AC corona discharge is generated in the ignition plug. In the technology disclosed in PLT 1, the power-source voltage of the DC power source and the primary voltage of the voltage boosting transformer are detected; a Q value is calculated from the voltage ratio between the two voltages; then, based on the Q value, it is detected whether or not a high-frequency AC corona discharge exists.

CITATION LIST

Patent Literature

PLT 1: JP 2014-224493 A

SUMMARY OF INVENTION

Technical Problem

Meanwhile, the inventor of the present application has developed a technology that in a time period before ignition, a discharge which does not lead to ignition is generated; ozone and radicals are produced in a fuel-air mixture and hence expansion of combustion at a time of ignition is facilitated; as a result, the ignitability is raised. However, because PLT 1 discloses only a technology for determining whether or not a corona discharge exists, it may be ignited, i.e., PLT 1 discloses no technology for determining whether or not a discharge exists at a time when a non-ignition discharge is implemented.

In order to cause a non-ignition discharge to occur, it is required to accurately control the application voltage of a barrier ignition plug. However, in the technology disclosed in PLT 1, based on the respective detection values of voltages at the primary side of the voltage boosting transformer, it is determined whether or not a discharge exists; thus, the technology is not suitable for the control accuracy, for the application voltage, that is required in a non-ignition discharge.

Therefore, there is required a barrier-discharge-type ignition apparatus that can accurately determine the application voltage, of a barrier ignition plug, that causes a non-ignition discharge to occur.

Solution to Problem

A barrier-discharge-type ignition apparatus according to the present disclosure includes:

A DC/DC converter that boosts a DC voltage and outputs the boosted DC voltage;

an inverter that inverts the DC voltage outputted from the DC/DC converter into an AC voltage and outputs the AC voltage;

a transformer that boosts the AC voltage outputted from the inverter and outputs the boosted AC voltage;

a resonance circuit that amplifies, by means of resonance, the AC voltage outputted from the transformer;

a barrier ignition plug to which the AC voltage amplified by the resonance circuit is applied, that is provided in a combustion chamber, and whose electrodes are covered with a dielectric;

a voltage detection circuit that detects an application voltage for the barrier ignition plug; and a controller that increases or decreases the application voltage for the barrier ignition plug by controlling the DC/DC converter and the inverter, wherein the controller performs combustion assist control that applies a non-ignition discharge voltage that causes a non-ignition discharge which is a discharge of the barrier ignition plug and does not lead to ignition of the fuel-air mixture, to the barrier ignition plug, in a combustion assist period which is a period set before ignition of a fuel-air mixture in the combustion chamber and for producing ozone and radicals and facilitating expansion of combustion at a time of ignition, and wherein in the combustion assist control, based on the application voltage detected by the voltage detection circuit, the controller calculates a voltage difference between the one-period-prior application voltage and the present-period application voltage in an AC period, and then determines whether or not a discharge exists in the barrier ignition plug, based on a comparison between the voltage difference and a preliminarily set discharge determination threshold value. Furthermore, it is desirable that based on the application voltage at a time when it is determined that a discharge has started in the barrier ignition plug, the controller determines a discharge starting voltage, which is the application voltage at which a discharge starts in the barrier ignition plug.

Advantage of Invention

In a barrier-discharge-type ignition apparatus according to the present disclosure, whether or not a non-ignition discharge exists can accurately be determined by a determination based on the foregoing voltage difference between the application voltages for the barrier ignition plug, by utilizing a change in the resonance frequency of a resonance circuit, which is caused by whether or not a discharge exists. Furthermore, a preferable embodiment makes it possible to accurately determine the discharge starting voltage, based on the application voltage for the barrier ignition plug at a time when it is determined that a non-ignition discharge has started.

DESCRIPTION OF EMBODIMENTS

Embodiment 1

Figure 1:
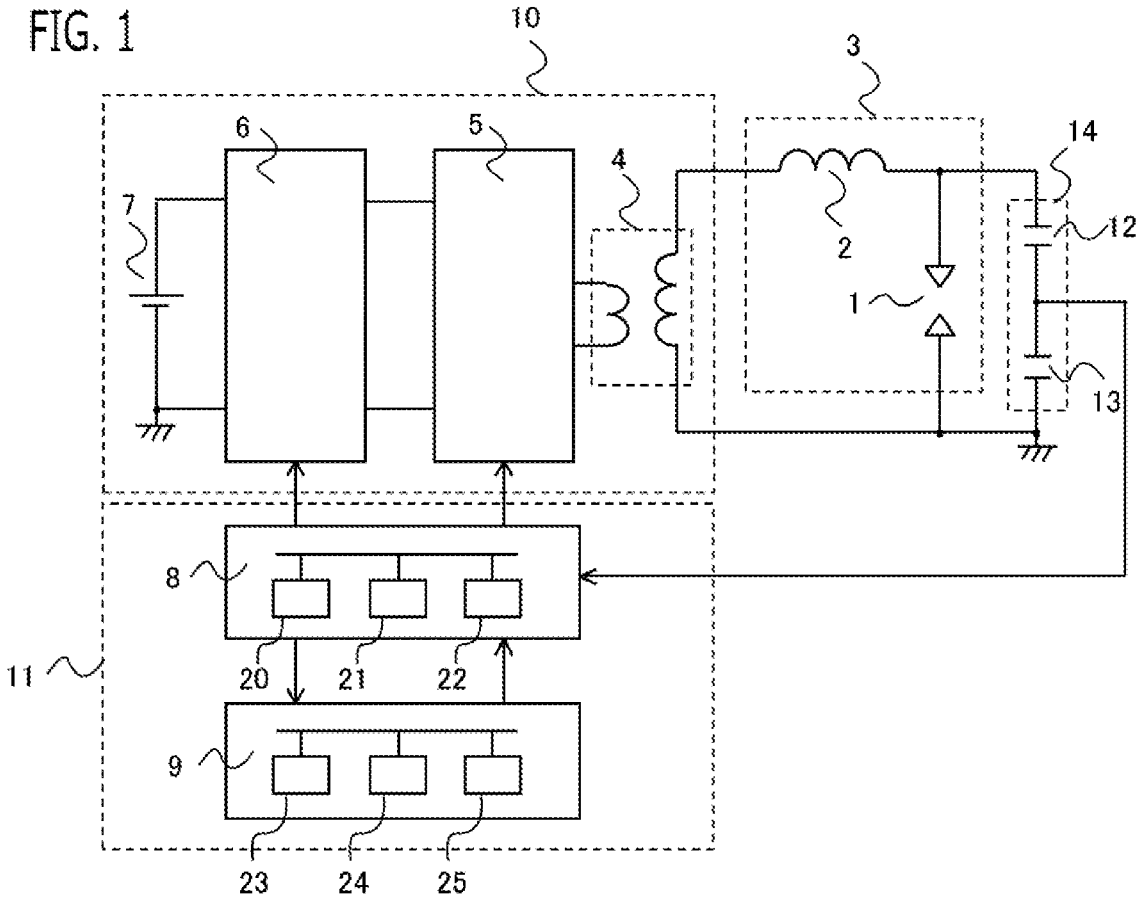
FIG. 1 is a diagram representing the circuit configuration of a barrier-discharge-type ignition apparatus according to Embodiment 1 of the present disclosure.

A barrier-discharge-type ignition apparatus according to Embodiment 1 will be explained with reference to drawings. FIG. 1 is a circuit configuration diagram of a barrier-discharge-type ignition apparatus. The barrier-discharge-type ignition apparatus is provided with a power source circuit 10 that supplies an AC voltage, a resonance circuit 3 that amplifies, by means of resonance, the AC voltage outputted from the power source circuit 10, a barrier ignition plug 1 to which the AC voltage amplified by the resonance circuit 3 is applied, and a controller 11 that controls the power source circuit 10. The barrier ignition plug 1 is provided in a combustion chamber of an internal combustion engine; the barrier-discharge-type ignition apparatus is an ignition apparatus for the internal combustion engine.

The electrode of the barrier ignition plug 1 is covered with a dielectric. For example, a rod-shaped central electrode is covered with a dielectric in the shape of a bottomed tube, and the circumference of the dielectric is surrounded by a tubular ground electrode via a discharge gap. The dielectric is formed of a dielectric material such as alumina, zirconia, or titania; the central electrode is formed of a conductive metal material such as Cu, Fe, or Ni; the ground electrode is formed of a conductive metal material such as Fe, Ni, or stainless steel.

The power source circuit 10 is provided with a battery 7 as a DC power source, a DC/DC converter 6 that boosts a DC voltage supplied from the battery 7 and outputs the boosted DC voltage, an inverter 5 that inverts the DC voltage outputted from the DC/DC converter 6 into an AC voltage and outputs the AC voltage, and a transformer 4 that boosts the AC voltage outputted from the inverter 5 and then outputs and supplies the AC voltage to the resonance circuit 3.

The DC/DC converter 6 boosts the DC voltage of the battery 7 to a DC voltage in a range from 50V to 600V and then outputs the boosted voltage to the inverter 5. The transformer 4 boosts the AC voltage, which has been obtained through the inversion by the inverter 5, to an AC voltage in a range from 500V to 30 kV and then outputs the boosted AC voltage to the resonance circuit 3. The AC voltage boosted by the transformer 4 is boosted to an AC voltage in a range from 5 kV to 50 kV by an effect of series resonance between an inductance element and a capacitance element of the resonance circuit 3 and is applied to the barrier ignition plug 1, thereby causing a discharge in the barrier ignition plug 1.

When a discharge occurs in the barrier ignition plug 1, a fuel-air mixture in a combustion chamber is ignited and then a flame explosively propagates in the fuel-air mixture in the combustion chamber. The internal combustion engine extracts energy from a pressure that has been raised by the combustion of the ignited fuel. Although the detail will be described later, in the present embodiment, before ignition is implemented, a non-ignition discharge that does not lead to ignition of a fuel-air mixture is generated; ozone and radicals are produced in the fuel-air mixture and hence expansion of combustion at a time of ignition is facilitated; as a result, the ignitability is raised.

The DC/DC converter 6 is provided with a switching device to be on/off-controlled by the controller 11. As the DC/DC converter 6, various kinds of publicly known converters can be utilized; for example, a boosting chopper provided with a switching device, a diode, and a reactor may be utilized; alternatively, an insulation-type DC/DC converter of, for example, a flyback type provided with a switching device, a diode, and a transformer may be utilized.

The inverter 5 is provided with a switching device to be on/off-controlled by the controller 11. As the inverter 5, various kinds of publicly known inverters can be utilized; for example, it may be allowed to utilize a half-bridge circuit provided with a series circuit in which two switching devices, each of which is connected with a diode in an anti-parallel manner, are connected in series with each other; alternatively, it may be allowed to utilize a full-bridge circuit in which two series circuits are connected in parallel with each other—in each of the two series circuits, two switching devices, each of which is connected with a diode in an anti-parallel manner, are connected in series with each other.

As each of the switching devices of the DC/DC converter 6 and the inverter 5, an IGBT (Insulated Gate Bipolar Transistor), a MOSFET (Metal Oxide Semiconductor Field Effect Transistor), or the like is utilized. The switching device may formed of not only a semiconductor utilizing Si (silicone) but also a wide bandgap semiconductor such as SiC (Silicon Carbide), GaN (Gallium Nitride), $Ga_2O_3$ (Gallium Oxide), or diamond.

The transformer 4 has a primary coil to be connected with the inverter 5, a secondary coil to be connected with the resonance circuit 3, and an iron core on which the primary coil and the secondary coil are wound. The boosting ratio of the transformer 4 is determined by the ratio of the number of turns of the secondary coil to the number of turns of the primary coil. In the case where the application voltage required for a discharge can be secured by the resonance circuit 3 alone, the transformer 4 may be removed.

The resonance circuit 3 is formed of a series circuit consisting of an inductance element and a capacitance element. In the present embodiment, the resonance circuit 3 is provided with a resonance coil 2. The resonance circuit 3 includes the inductance component of the resonance coil 2, the capacitance component of the barrier ignition plug 1, and the leakage inductance component of the transformer 4. The resonance circuit 3 may include the inductance component of the resonance coil 2 and the capacitance component of the barrier ignition plug 1; alternatively, the resonance circuit 3 may include the leakage inductance component of the transformer 4 and the capacitance component of the barrier ignition plug 1. Moreover, the capacitance component of the resonance circuit 3 may be increased or decreased by connecting a capacitance element such as a capacitor in parallel or in series with the barrier ignition plug 1.

The barrier-discharge-type ignition apparatus is provided with a voltage detection circuit 14 that detects an application voltage to be applied to the barrier ignition plug 1. In the present embodiment, the voltage detection circuit 14 is a voltage dividing capacitor circuit 14 connected in parallel with the barrier ignition plug 1. The voltage dividing capacitor circuit 14 consists of a first voltage dividing capacitor 12 and a second voltage dividing capacitor 13 that are connected in series with each other. The first voltage dividing capacitor 12 side is connected with the wiring lead for the resonance coil 2 and the barrier ignition plug 1, and the second voltage dividing capacitor 13 side is connected with a reference voltage. By use of the first voltage dividing capacitor 12 and the second voltage dividing capacitor 13, the voltage dividing capacitor circuit 14 divides a high voltage of substantially 5 kV through 50 kV to be applied to the barrier ignition plug 1. The capacitance value of the second voltage dividing capacitor 13 is large enough in comparison with that of the first voltage dividing capacitor 12; for example, a capacitor having a capacitance value that is substantially 500 times as large as that of the first voltage dividing capacitor 12 is selected. The division voltage of the second voltage dividing capacitor 13 is substantially 0.5 V through 100 V and is inputted, as information on the application voltage for the barrier ignition plug 1, to the controller 11. The voltage detection circuit 14 may be a voltage dividing resistor circuit consisting of a first voltage dividing resistor and a second voltage dividing resistor that are connected in series with each other, and the division voltage of the second voltage dividing resistor may be inputted, as the information on the application voltage for the barrier ignition plug 1, to the controller 11.

Controller 11

The controller 11 increases or decreases the application voltage for the barrier ignition plug 1 by controlling the DC/DC converter 6 and the inverter 5. A processing circuit of the controller 11 may be formed of analogue electronic circuits such as a comparator, an operational amplifier, and a differential amplification circuit, may be formed of digital electronic circuits such as a computing processing unit, a storage device, and an input/output circuit, or may be formed of both digital electronic circuits and analogue electronic circuits.

In this Embodiment, as the computing processing unit, a CPU (Central Processing Unit), a DSP (Digital Signal Processor), an ASIC (Application Specific Integrated Circuit), a FPGA (Field Programmable Gate Array), or the like is utilized. It may be allowed that as the computing processing unit, two or more computing processing units of the same type or different types are provided and respective processing items are implemented in a sharing manner. As the storage device, a RAM (Random Access Memory), a ROM (Read Only Memory), or the like is utilized. The input/output circuit is provided with an input circuit such as an A/D converter or the like for inputting the output signals of various kinds of sensors, switches, and the like to the computing processing unit and with an output circuit such as a driving circuit or the like for outputting control signals from the computing processing unit to an electric load and the like. The computing processing unit such as a CPU implements programs stored in the storage device such as a ROM and collaborates with other hardware devices such as the storage device and the input/output circuit in the controller 11, so that the respective processing items are implemented.

In the present embodiment, the controller 11 is provided with a control circuit 8 and an engine control unit 9 (hereinafter, referred to as ECU 9). ECU 9 is a main controller that integrally controls the internal combustion engine; the control circuit 8 controls the DC/DC converter 6 and the inverter 5 in such a way that a discharge occurs in the barrier ignition plug 1 in an ignition period or in a combustion assist period that is specified by the ECU 9.

The control circuit 8 is provided with a computing processing unit 20, a storage device 21, and an input/output circuit 22. The ECU 9 is provided with a computing processing unit 23, a storage device 24, and an input/output circuit 25. The control circuit 8 and the ECU 9 collaborate with each other through communication.

Based on the output signal of a crank angle sensor or the like, ECU 9 detects a rotation speed and a rotation angle of the internal combustion engine, and detects an intake air amount taken into the combustion chamber of the internal combustion engine, based on the output signal of an intake air amount sensor. Then, based on the rotation speed, the intake air amount, and the like of the internal combustion engine, ECU 9 calculates an ignition angle and a non-ignition discharge angle, and determines the ignition period or the timing of the combustion assist period, based on the ignition angle, the non-ignition discharge angle, and the rotation angle of the internal combustion engine; then, ECU 9 issues a command to the control circuit 8.

Information on the application voltage for the barrier ignition plug 1 is inputted to the control circuit 8 from the voltage detection circuit 14. In the ignition period and at the timing of the combustion assist period specified by the ECU 9, the control circuit 8 performs on/off-driving of the switching devices in the DC/DC converter 6 and the inverter 5 through PWM (Pulse Width Modulation) control so as to boost the application voltage for the barrier ignition plug 1.

In the case where the DC/DC converter 6 is a boosting chopper, the control circuit 8 increases or decreases the on-duty ratio of the switching device in the DC/DC converter 6 so as to increase or decrease the output DC voltage.

In the case where the inverter 5 is formed of a half-bridge circuit in which a first switching device and a second switching device are connected in series with each other, the control circuit 8 alternately turns on the first switching device and the second switching device in an AC voltage period (referred to also as an AC period) so as to invert a DC voltage into an AC voltage with the AC voltage period. It may be allowed that the control circuit 8 increases or decreases the output AC voltage by prolonging or shortening each of the on-periods (on-duty ratios) of the first switching device and the second switching device within the half of the AC voltage period.

Method of Changing Application Voltage

The methods of changing the application voltage for the barrier ignition plug 1 include a method of changing the output DC voltage for the DC/DC converter 6, a method of changing the AC frequency to be generated by the inverter 5, and the like. When the AC frequency of the inverter 5 is made to be close to the resonance frequency, the voltage amplification gain Vgain, described later, of the resonance circuit 3 increases; thus, the application voltage for the barrier ignition plug 1 increases. An AC frequency is the reciprocal of an AC period.

It may be allowed that in order to reduce the overall-conversion-apparatus power loss in the DC/DC converter 6 and the inverter 5, the output DC voltage of the DC/DC converter 6 and the AC frequency of the inverter 5 are concurrently changed. Specifically, when the output DC voltage of the DC/DC converter 6 is changed, the voltages to be applied to the switching devices in the DC/DC converter 6 and the inverter 5 change, and hence the switching loss per switching changes. Moreover, when the AC frequency of the inverter 5 is changed, the number of switching actions of the inverter 5 increases or decreases, and hence the switching loss changes. It may be allowed that the output DC voltage of the DC/DC converter 6 and the AC frequency of the inverter 5 are changed in such a way that the total loss in the overall conversion apparatus is reduced.

Figure 2:
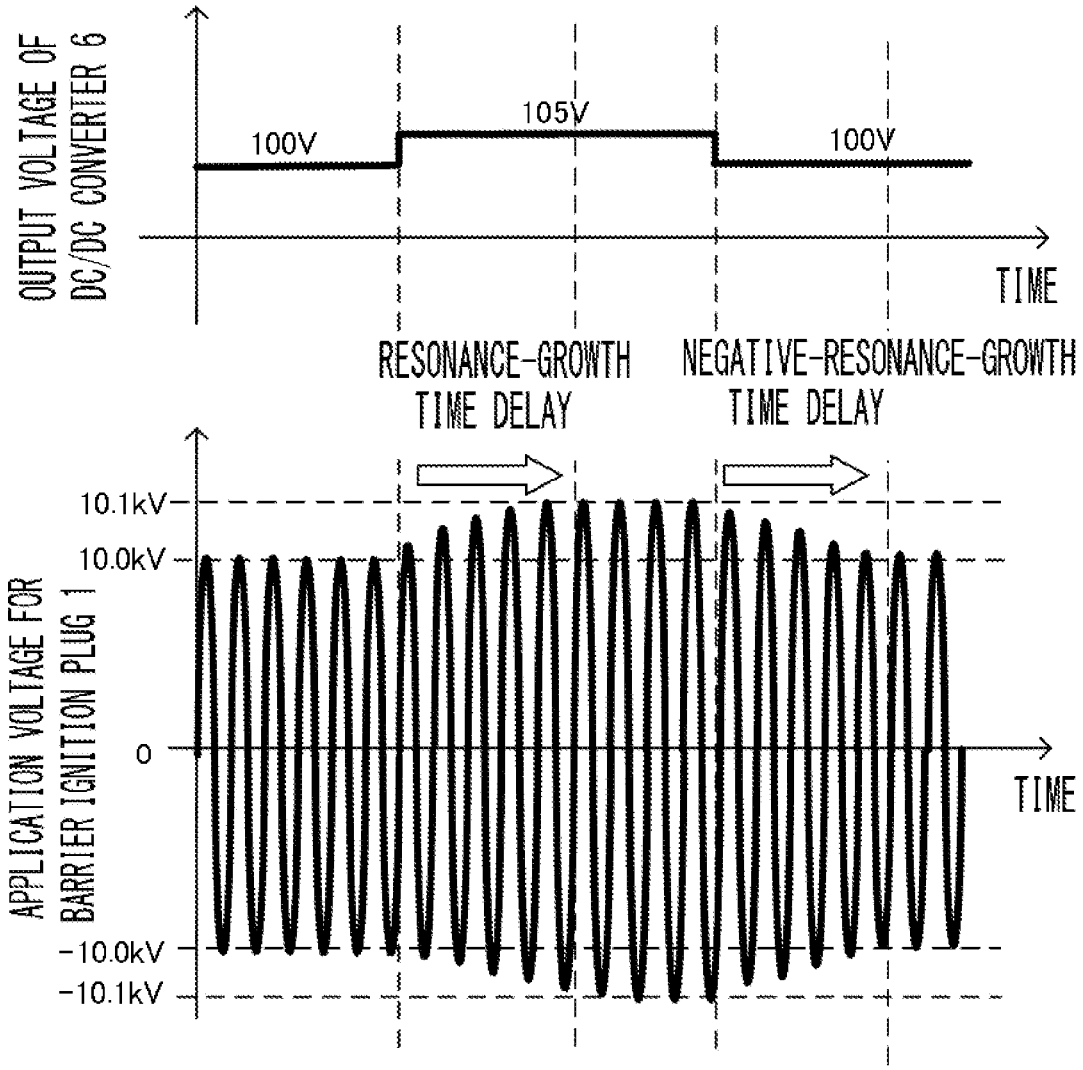
FIG. 2 is a timing chart representing the respective time delays caused by resonance growth and negative resonance growth in a resonance circuit at a time when the output voltage of a DC/DC converter according to Embodiment 1 of the present disclosure is changed.

FIG. 2 represents a control behavior at a time when the output DC voltage of the DC/DC converter 6 is changed. In FIG. 2, the abscissa denotes the time; the ordinate denotes the output voltage of the DC/DC converter 6 and the application voltage for the barrier ignition plug 1. Even when in order to raise the application voltage for the barrier ignition plug 1 by 0.1 kV, the output DC voltage of the DC/DC converter 6 is raised by 5V in a stepped manner, the rise in the application voltage for the barrier ignition plug 1 is delayed, due to a time delay for the resonance in the resonance circuit 3 to grow. This time delay will be referred to as a resonance-growth time delay. Even when in contrast, the output voltage of the DC/DC converter 6 is decreased by 5V in a stepped manner, the fall in the application voltage for the barrier ignition plug 1 is delayed, due to a time delay for the resonance to negatively grow. This time delay will be referred to as a negative-resonance-growth time delay.

Figure 3:
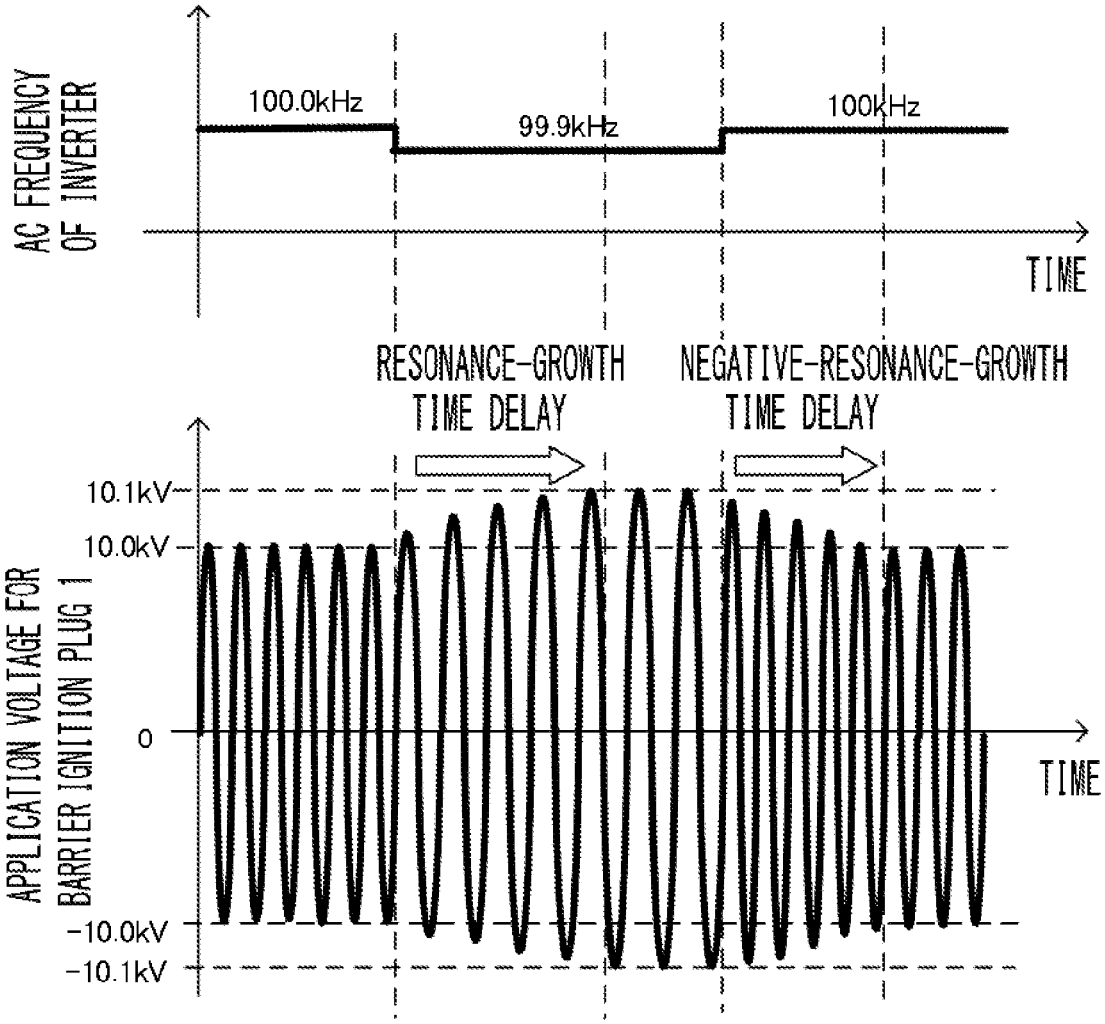
FIG. 3 is a timing chart representing the respective time delays caused by resonance growth and negative resonance growth in a resonance circuit at a time when the AC frequency of an inverter according to Embodiment 1 of the present disclosure is changed.

FIG. 3 represents a control behavior at a time when the AC frequency of the inverter 5 is changed. In FIG. 3, the abscissa denotes the time; the ordinate denotes the AC frequency of the inverter 5 and the application voltage for the barrier ignition plug 1. Even when in order to raise the application voltage for the barrier ignition plug 1 by 0.1 kV, the AC frequency of the inverter 5 is decreased by 0.1 kHz in a stepped manner, the rise in the application voltage for the barrier ignition plug 1 is delayed, due to a time delay for the resonance in the resonance circuit 3 to grow. Even when in contrast, the AC frequency of the inverter 5 is increased by 0.1 kHz in a stepped manner, the fall in the application voltage for the barrier ignition plug 1 is delayed, due to a time delay for the resonance to negatively grow.

Ignition Control and Combustion Assist Control

The basic operation of the controller 11 will be explained with reference to FIG. 4. Before a fuel-air mixture in the combustion chamber is ignited, a non-ignition discharge which is a barrier discharge of the barrier ignition plug 1 and does not lead to ignition of the fuel-air mixture, is generated, thereby producing ozone and radicals in the fuel-air mixture, so that the expansion of combustion at a time of ignition is facilitated and hence improvement of the ignitability is achieved. For that purpose, the controller 11 performs combustion assist control that applies a non-ignition discharge voltage which is an AC voltage that causes a non-ignition discharge of the barrier ignition plug and does not lead to ignition of the fuel-air mixture, to the barrier ignition plug 1, in the combustion assist period, which is a period set before ignition of a fuel-air mixture in the combustion chamber, and which is for producing ozone and radicals and facilitating expansion of combustion at a time of ignition. In other words, in the combustion assist period, control is performed in such a way as to generate a voltage that does not cause ignition, so that in the barrier ignition plug, there is generated a discharge having energy that is so weak in comparison with the energy causing ignition that no ignition occurs. The combustion assist period is set in at least one of the air intake stroke and the compression stroke among the respective strokes of air intake, compression, expansion, and exhaust in the internal combustion engine. Moreover, the controller 11 performs ignition control in which in an ignition period, the application voltage for the barrier ignition plug 1 is boosted up to the ignition voltage, which is an AC voltage that causes a fuel-air mixture in the combustion chamber to be ignited.

Figure 4:
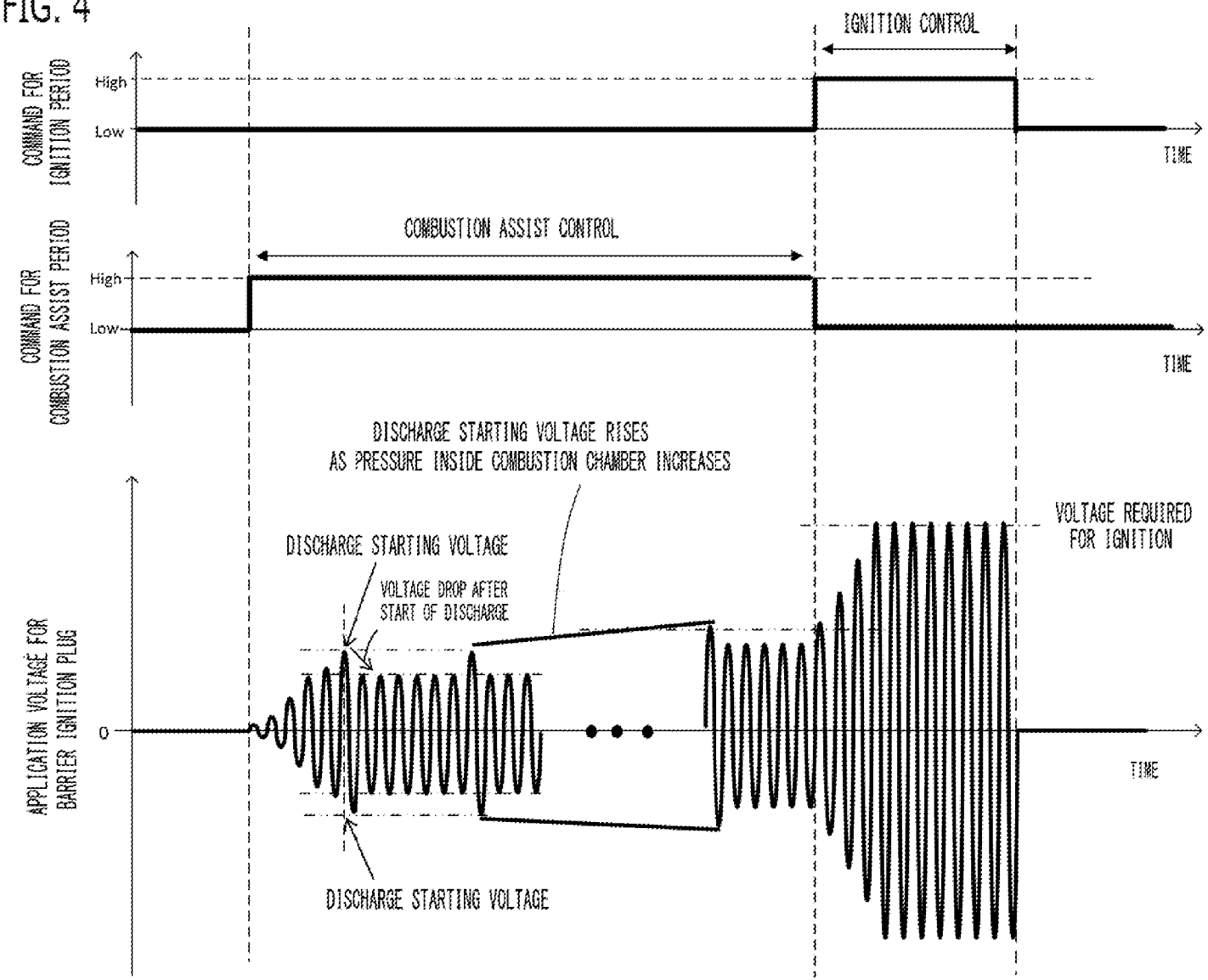
FIG. 4 is a timing chart for explaining ignition control and combustion assist control according to Embodiment 1 of the present disclosure.

In FIG. 4, the abscissa denotes the time; the ordinate denotes the command for an ignition period, the command for a combustion assist period, and the application voltage for the barrier ignition plug 1. When the combustion assist period specified by the ECU 9 is High, the control circuit 8 applies to the barrier ignition plug 1 the non-ignition discharge voltage for causing a non-ignition discharge to occur. Moreover, when the ignition period specified by the ECU 9 is High, the control circuit 8 applies an ignition voltage for causing ignition to occur to the barrier ignition plug 1. The non-ignition discharge voltage becomes a voltage that is drastically low in comparison with the ignition voltage; for example, the non-ignition discharge voltage is 5 kV and the ignition voltage is the same as or larger than 20 kV.

In order to change the application voltage for the barrier ignition plug 1 at high speed in accordance with a change in the operation state of the internal combustion engine, the control, without the intermediary of ECU 9, is performed in the control circuit 8 in such a way that a voltage required for ignition is applied to the barrier ignition plug 1. The control circuit 8 transmits signals for discharge detection, the application voltage for the barrier ignition plug 1, the pressure in the combustion chamber, and the like to ECU 9.

In the present embodiment, the controller 8 increases or decreases the output DC voltage of the DC/DC converter 6 by changing the voltage boosting rate of the DC/DC converter 6, thereby increasing or decreasing the application voltage for the barrier ignition plug 1. Moreover, the control circuit 8 controls the frequency (AC frequency) of the AC voltage outputted from the inverter 5 to be at a control frequency fc, which is preliminarily set within the resonance frequency band in which due to resonance in the resonance circuit 3, the AC voltage is amplified.

Determination on Discharge Starting Voltage, Utilizing Change in Resonance Frequency Depending on Whether or Not Discharge Exists In the combustion assist control, when the application voltage for the barrier ignition plug 1 is too high, the discharge energy is too large and hence the fuel-air mixture may be ignited. In contrast, when the application voltage for the barrier ignition plug 1 is too low, no discharge occurs. As represented in FIG. 4, in the compression stroke of the internal combustion engine, because as the pressure in the combustion chamber rises, the discharge starting voltage also rises, it is required to raise the application voltage for the barrier ignition plug 1 in order to maintain the non-ignition discharge. Accordingly, it is required to apply an appropriate voltage, which causes a non-ignition discharge to occur, to the barrier ignition plug 1. Therefore, in the present embodiment, a change in the resonance frequency of the resonance circuit 3, that is caused by whether or not a discharge exists, is utilized; based on the application voltage for the barrier ignition plug 1 detected by the voltage detection circuit 14, whether or not a discharge exists and the discharge starting voltage are determined; then, the application voltage is made to be appropriate.

Figure 5:
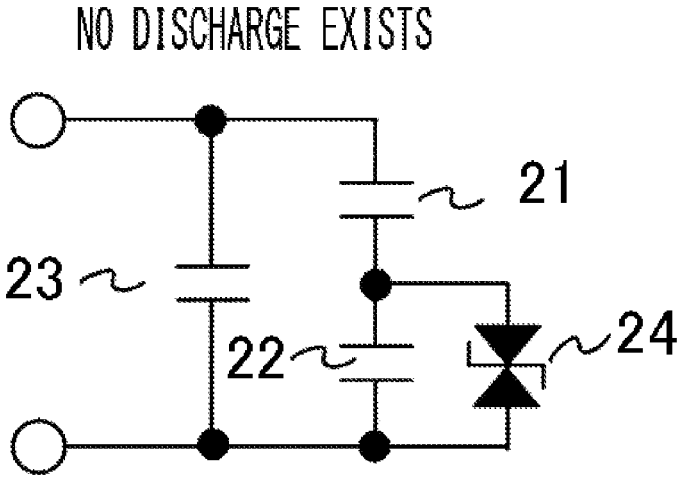
FIG. 5 is a diagram representing the equivalent circuit of a barrier ignition plug according to Embodiment 1 of the present disclosure, at a time when no discharge exists.

Hereinafter, the principle of a change, in the resonance frequency of the resonance circuit 3, that is caused by whether or not a discharge exists will be explained. FIG. 5 is an equivalent circuit of the barrier ignition plug 1 at a time when no discharge occurs; the equivalent circuit can be expressed by an electrostatic capacitance 21 of a dielectric of the barrier ignition plug 1, an electrostatic capacitance 22 of a gas between the discharge gaps, a parasitic electrostatic capacitance 23 of the barrier ignition plug 1, and a bidirectional Zener diode 24. The bidirectional Zener diode 24 is a circuit that simulates whether or not a discharge exists between the discharge gaps of the barrier ignition plug 1; when the application voltage excesses the positive or negative breakdown voltage corresponding to the discharge starting voltage, the bidirectional Zener diode 24 becomes conductive.

Figure 6:
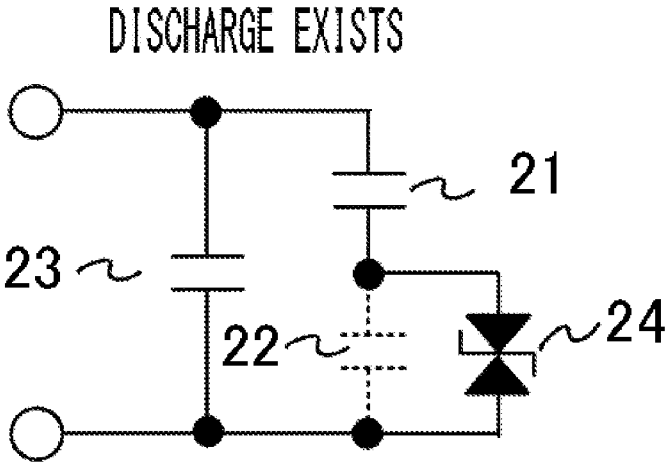
FIG. 6 is a diagram representing the equivalent circuit of a barrier ignition plug according to Embodiment 1 of the present disclosure, at a time when a discharge exists.

FIG. 6 is an equivalent circuit of the barrier ignition plug 1 at a time when a discharge exists; the difference from FIG. 5 is that because a discharge starts and hence the bidirectional Zener diode 24 is conductive, the electrostatic capacitance 22, of the gas between the discharge gaps, that is connected in parallel with the bidirectional Zener diode 24 can be neglected (expressed by a dotted line in FIG. 6) and hence the equivalent circuit becomes a parallel circuit consisting of the electrostatic capacitance 21 of the dielectric of the barrier ignition plug 1 and the parasitic electrostatic capacitance 23 of the barrier ignition plug 1. Letting C1 denote the combined electrostatic capacitance in the equivalent circuit at a time when no discharge exists and letting C2 denote the combined electrostatic capacitance in the equivalent circuit at a time when a discharge exists, whether or not a discharge exists changes the combined electrostatic capacitance in the equivalent circuit; the combined electrostatic capacitance C2 in the equivalent circuit at a time when a discharge exists is larger than the combined electrostatic capacitance C1 in the equivalent circuit at a time when no discharge exists.

Due to a change in the combined electrostatic capacitance of the barrier ignition plug 1 caused by whether or not a discharge exists, the resonance frequency of the resonance circuit 3 changes. The resonance frequency f of the resonance circuit 3 is given by the equation (1) from the inductance L of the resonance coil 2, the leakage inductance of the transformer 4, and the like, and the combined electrostatic capacitance C of the barrier ignition plug 1. The equation (1) suggests that when a discharge starts and hence the combined electrostatic capacitance C of the barrier ignition plug 1 increases, the resonance frequency f decreases.

$$f=1/(2\cdot\pi\cdot\sqrt{(L\cdot C)}) \quad (1)$$

Figure 7:
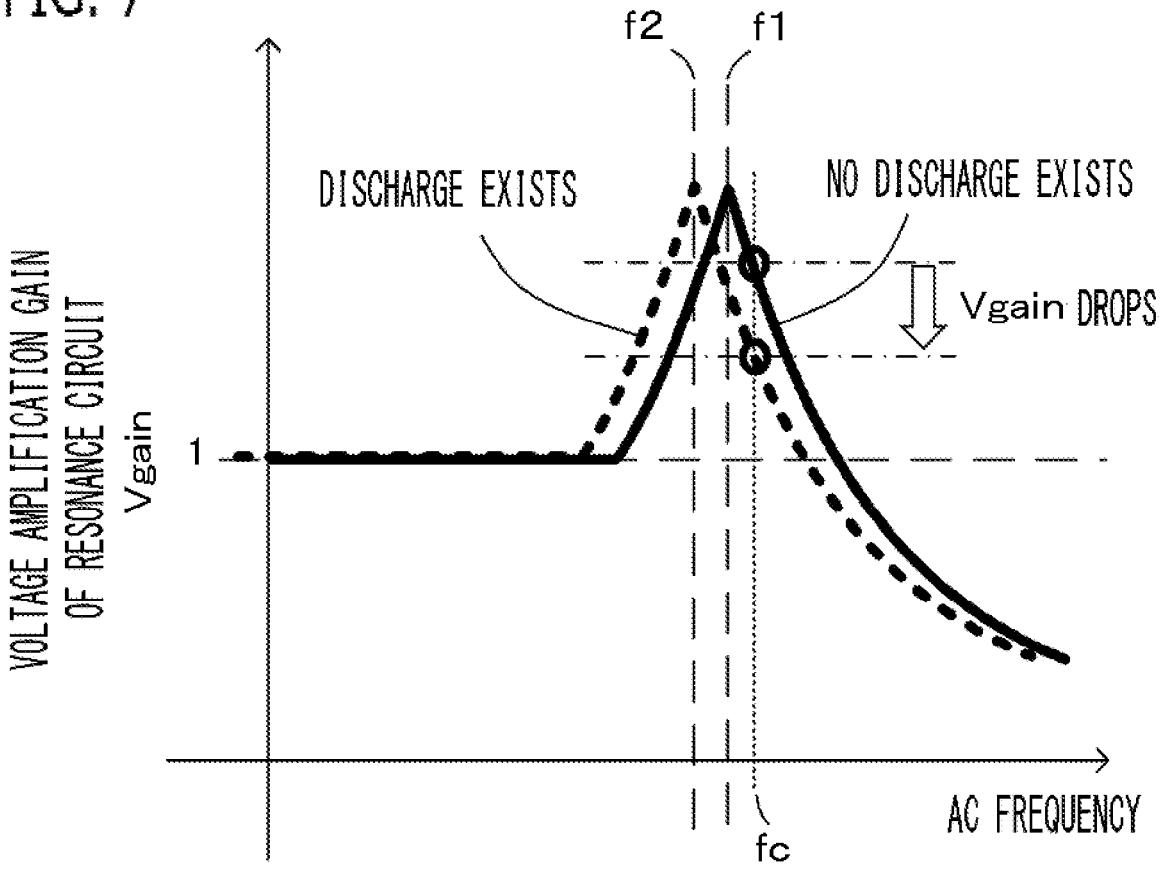
FIG. 7 is a frequency response chart representing a change in the resonance frequency of the resonance circuit according to Embodiment 1 of the present disclosure, depending on whether or not a discharge exists.

FIG. 7 represents the frequency response of the voltage amplification gain Vgain of the resonance circuit 3. In FIG. 7, the abscissa denotes the AC frequency, and the ordinate denotes the voltage amplification gain Vgain of the resonance circuit 3; the solid line represents the frequency response at a time when no discharge exists, and the dotted line represents the frequency response at a time when a discharge exists. In the case where the voltage amplification gain Vgain is 1, the AC voltage is not amplified by the resonance circuit 3 and then the output AC voltage of the transformer 4 is directly applied to the barrier ignition plug 1. At the resonance frequency, the voltage amplification gain Vgain takes the maximum peak value. In the resonance frequency band including the resonance frequency, the voltage amplification gain Vgain is larger than 1; thus, the output AC voltage of the transformer 4 is amplified by the resonance circuit 3 and is applied to the barrier ignition plug 1.

The resonance frequency f2 at a time when a discharge exists is lower than the resonance frequency f1 at a time when no discharge exists. At a frequency the same as or higher than the resonance frequency f1 at a time when no discharge exists, because even when the AC frequency is the same, the voltage amplification gain Vgain decreases when a discharge starts, the application voltage for the barrier ignition plug 1 decreases by the amount corresponding to the decrease in the voltage amplification gain Vgain. In contrast, when the discharge stops, the voltage amplification gain Vgain increases; therefore, the application voltage for the barrier ignition plug 1 increases by the amount corresponding to the increase in the voltage amplification gain Vgain.

At a frequency, in the resonance frequency band, that is the same as or lower than the resonance frequency f2 at a time when a discharge exists, because even when the AC frequency is the same, the voltage amplification gain Vgain increases when a discharge starts, the application voltage for the barrier ignition plug 1 increases by the amount corresponding to the increase in the voltage amplification gain Vgain. In contrast, when the discharge stops, the voltage amplification gain Vgain decreases; therefore, the application voltage for the barrier ignition plug 1 decreases by the amount corresponding to the decrease in the voltage amplification gain Vgain.

Accordingly, it can be understood that the application voltage for the barrier ignition plug 1 at a time when a discharge starts and the application voltage for the barrier ignition plug 1 at a time when the discharge stops differ from each other and that it can be determined whether or not a discharge exists, by use of the voltage difference. Accordingly, in the combustion assist control, based on the application voltage detected by the voltage detection circuit 14, the control circuit 8 calculates a voltage difference Vd between the one-period-prior application voltage and the present-period application voltage in the AC period, and then determines whether or not a discharge exists in the barrier ignition plug 1, based on the comparison between the voltage difference Vd and a preliminarily set discharge determination threshold value. Then, based on the application voltage at a time when it is determined that a discharge has started in the barrier ignition plug 1, the control circuit 8 determines the discharge starting voltage, which is the application voltage at which a discharge starts in the barrier ignition plug 1.

In the present embodiment, in the combustion assist control, the control circuit 8 controls the frequency of the output AC voltage of the inverter 5 to a control frequency fc, which is a frequency within the resonance frequency band in which an AC voltage is amplified due to the resonance in the resonance circuit 3 and which is set to be the same as or higher than the resonance frequency f1 of the resonance circuit 3 at a time when no discharge exists. Then, when the voltage difference Vd obtained by subtracting the present-period application voltage from the one-period-prior application voltage is larger than a positive discharge determination threshold value VJH, which is set to a positive value, the control circuit 8 determines that a discharge has started in the barrier ignition plug 1; when the voltage difference Vd is smaller than a negative discharge determination threshold value VJL, which is set to a negative value, the control circuit 8 determines that the discharge has stopped in the barrier ignition plug 1; when the voltage difference Vd is between the positive discharge determination threshold value VJH and the negative discharge determination threshold value VJL, the control circuit 8 determines that the discharge state of the barrier ignition plug 1, which has been determined at the immediately previous time, is being maintained.

Figure 8:
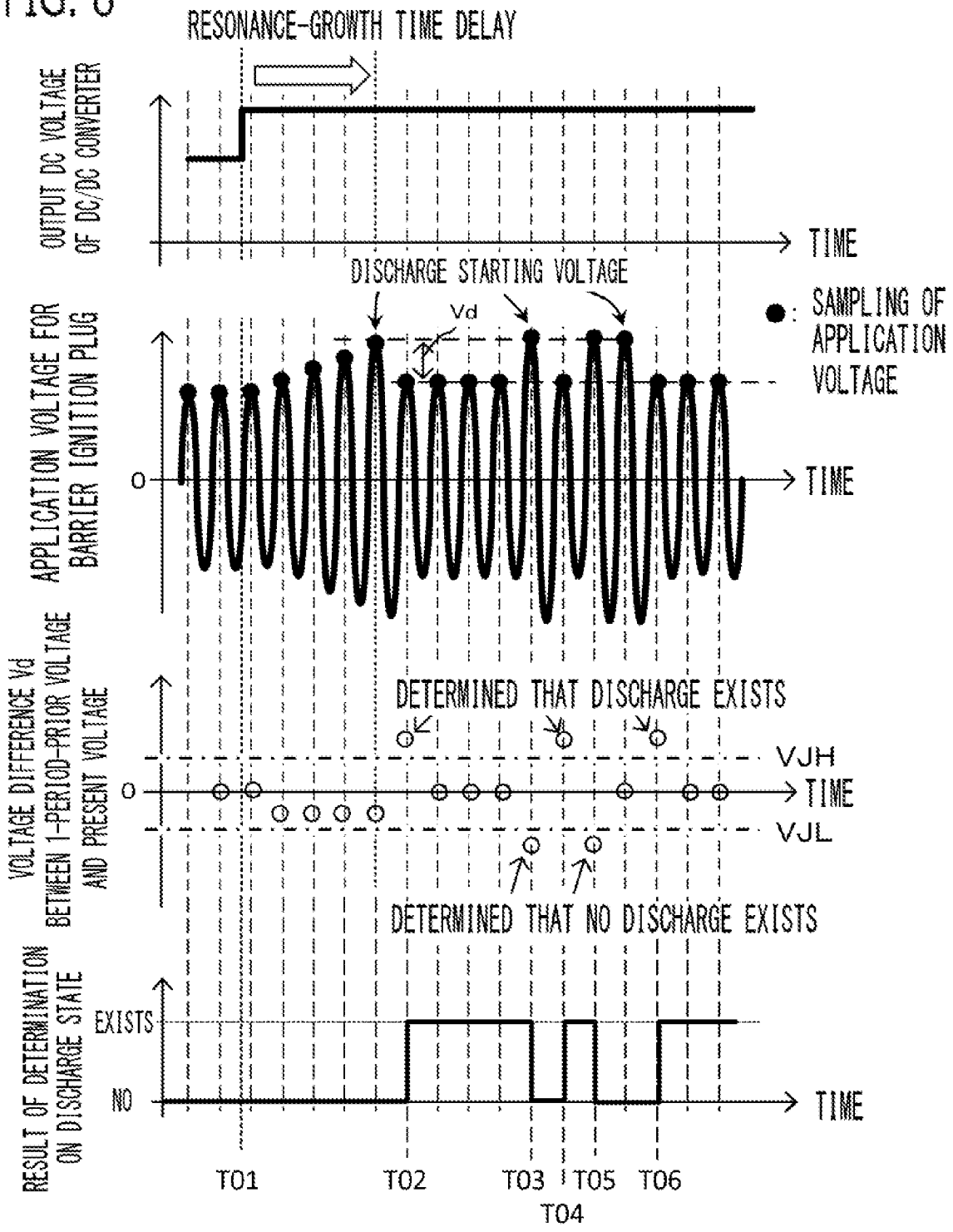
FIG. 8 is a timing chart for explaining determinations on whether or not a discharge exists and on a discharge start voltage according to Embodiment 1 of the present disclosure.

FIG. 8 represents the behavior of the determination on whether or not a discharge exists and the discharge starting voltage. In FIG. 8, the abscissa denotes the time; the ordinate denotes the output DC voltage of the DC/DC converter 6, the application voltage for the barrier ignition plug 1, the application-voltage voltage difference Vd, and the result of the determination on whether or not a discharge exists. At a time point T01, the output voltage of the DC/DC converter 6 is raised; then, due to a time delay for resonance growth, the application voltage for the barrier ignition plug 1 rises in a delayed manner. The control circuit 8 detects the maximum peak value of the application voltage in the AC period, as the application voltage.

Because the application voltage has risen up to the discharge starting voltage, a discharge has started; at a time point T02, the present-period application voltage decreases from the one-period-prior application voltage. Accordingly, the voltage difference Vd obtained by subtracting the present-period application voltage from the one-period-prior application voltage increases. The positive discharge determination threshold value VJH is set, corresponding to the decrease in the voltage amplification gain Vgain, which is caused by the start of the discharge; the voltage difference Vd is larger than the positive discharge determination threshold value VJH. Thus, at the time point T02, the control circuit 8 determines that a discharge has started in the barrier ignition plug 1. In addition, the control circuit 8 determines the one-period-prior application voltage, as the discharge starting voltage.

After that, because the discharge continues for three AC periods, the application-voltage voltage difference Vd has decreased and is between the positive discharge determination threshold value VJH and the negative discharge determination threshold value VJL, the control circuit 8 determines that the state where a discharge exists is continuing.

Because at a time point T03 in the next AC period, the discharge stops, for example, due to the effect of an increase in the pressure inside the combustion chamber, the application voltage increases and hence the voltage difference Vd decreases. The negative discharge determination threshold value VJL is set, corresponding to the increase in the voltage amplification gain Vgain, which is caused by the stop of the discharge; the voltage difference Vd is smaller than the negative discharge determination threshold value VJL. Thus, at the time point T03, the control circuit 8 determines that the discharge has stopped in the barrier ignition plug 1.

Because at a time point T04 in the next AC period, the discharge restarts, the application voltage decreases and hence the voltage difference Vd is larger than the positive discharge determination threshold value VJH. Thus, at the time point T04, the control circuit 8 determines that a discharge has started in the barrier ignition plug 1. In addition, the control circuit 8 determines the one-period-prior application voltage, as the discharge starting voltage.

Because at a time point T05 in the next AC period, the discharge stops, the application voltage increases and hence the voltage difference Vd is smaller than the negative discharge determination threshold value VJL. Thus, at the time point T05, the control circuit 8 determines that the discharge has stopped in the barrier ignition plug 1.

In the next AC period, because the stop state of the discharge continues, the application-voltage voltage difference Vd is between the positive discharge determination threshold value VJH and the negative discharge determination threshold value VJL; thus, the control circuit 8 determines that the state where no discharge exists is continuing.

Because at a time point T06 in the next AC period, the discharge restarts, the application voltage decreases and hence the voltage difference Vd is larger than the positive discharge determination threshold value VJH. Thus, at the time point T06, the control circuit 8 determines that a discharge has started in the barrier ignition plug 1. In addition, the control circuit 8 determines the one-period-prior application voltage, as the discharge starting voltage. After that, the discharge continues for two AC periods.

The control circuit 8 may change the discharge determination threshold values VJH and VJL in accordance with the PD product calculated by multiplying the pressure P inside the combustion chamber by the discharge gap D. For example, when the pressure P inside the combustion chamber and the discharge gap D are large, the PD product becomes large. When the PD product is large, a discharge that occurs in the discharge gap is strong and hence the voltage difference Vd between the application voltages becomes large, the respective absolute values of the discharge determination threshold values VJH and VJL are set to large values. In contrast, when the PD product is small, a discharge that occurs in the discharge gap is weak and hence the voltage difference Vd between the application voltages becomes small, the respective absolute values of the discharge determination threshold values VJH and VJL are set to small values. In other words, the control circuit 8 increases the respective absolute values of the discharge determination threshold values VJH and VJL as the PD product becomes larger.

Moreover, it may be allowed that when the PD product is smaller than a preliminarily set determination value, the control circuit 8 performs a probability determination. Specifically, it may be allowed that the control circuit 8 calculates the probability that the voltage difference Vd is between the positive discharge determination threshold value VJH and a positive probability determination threshold value that is set to a positive value smaller than the positive discharge determination threshold value VJH or the probability that the voltage difference Vd is between the negative discharge determination threshold value VJL and a negative probability determination threshold value that is set to a negative value larger than the negative discharge determination threshold value VJL and that when the calculated probability is larger than the preliminarily set determination value, the control circuit 8 determines that a discharge has started in the barrier ignition plug 1.

Control of Application Voltage

It is only necessary that control circuit 8 changes the command value for the non-ignition discharge voltage to be applied to the barrier ignition plug 1, based on the determined discharge starting voltage, so that even when various kinds of variation factors and fluctuation factors occur, a non-ignition discharge is securely made to occur in the barrier ignition plug 1.

In particular, it is only necessary that the control circuit 8 changes the command value for the non-ignition discharge voltage to be applied to the barrier ignition plug 1 to a voltage obtained by adding a preliminarily set offset voltage $\alpha$ to the determined discharge starting voltage, so that the control is performed in such a way that in the combustion assist period, a discharge is continuously produced in the barrier ignition plug 1 and no ignition starts. The offset voltage $\alpha$ is preliminarily set to a voltage value at which a discharge can be maintained but no ignition starts.

As represented in FIG. 8, it is only necessary that in the combustion assist period, starting and stopping of a discharge are implemented two or more times and the discharge starting voltage is determined two or more times, so that the detecting accuracy for the discharge starting voltage is raised. For that purpose, it is only necessary that the control circuit 8 changes the command value for the non-ignition discharge voltage to be applied to the barrier ignition plug 1 to the determined discharge starting voltage or to a voltage obtained by adding a voltage smaller than the offset voltage $\alpha$ to the discharge starting voltage.

Learning Control of Command Value for Non-Ignition Discharge Voltage, Based on Discharge Starting Voltage After the combustion assist control starts, the control circuit 8 controls the frequency of the AC voltage outputted from the inverter 5 to the preliminarily set control frequency fc in the resonance frequency band; concurrently, the control circuit 8 raises the output AC voltage of the inverter 5 until it is determined that a discharge has started in the barrier ignition plug 1. After it is determined that a discharge has started in the barrier ignition plug 1, the control circuit 8 increases or decreases the output AC voltage of the inverter 5 so that the application voltage approaches the command value for the non-ignition discharge voltage. Then, the control circuit 8 performs learning control of changing the command value for the non-ignition discharge voltage, which is utilized next time, so that the voltage difference between the discharge starting voltage determined this time and the command value for the non-ignition discharge voltage utilized this time decreases.

In the present embodiment, the control circuit 8 changes the command value for the non-ignition discharge voltage, which is utilized next time, so that the voltage difference between the discharge starting voltage determined this time and the command value for the non-ignition discharge voltage utilized this time gradually decreases. In other words, the reflection rate of the voltage difference to the next-time command value is set to a small value; thus, the voltage difference is reflected in the command value in an average manner, and the command value becomes the learning value of the voltage difference.

Moreover, the control circuit 8 changes the command value for the non-ignition discharge voltage, which is utilized in the next combustion assist period, so that the voltage difference between the discharge starting voltage determined in the present combustion assist period and the command value for the non-ignition discharge voltage utilized in the present combustion assist period decreases.

Alternatively, in the case where as represented in FIG. 8, starting and stopping of a discharge are implemented two or more times in the combustion assist period and the discharge starting voltage is determined two or more times, the control circuit 8 may change the command value for the non-ignition discharge voltage, which is utilized after it is determined that the next discharge has started, each time the discharge starting voltage is determined, even in the present combustion assist period.

The control circuit 8 increases or decreases the output DC voltage of the DC/DC converter 6 so as to increase or decrease the output AC voltage of the inverter 5. The increasing or decreasing of the output DC voltage of the DC/DC converter 6 is implemented every AC period.

Figure 9:
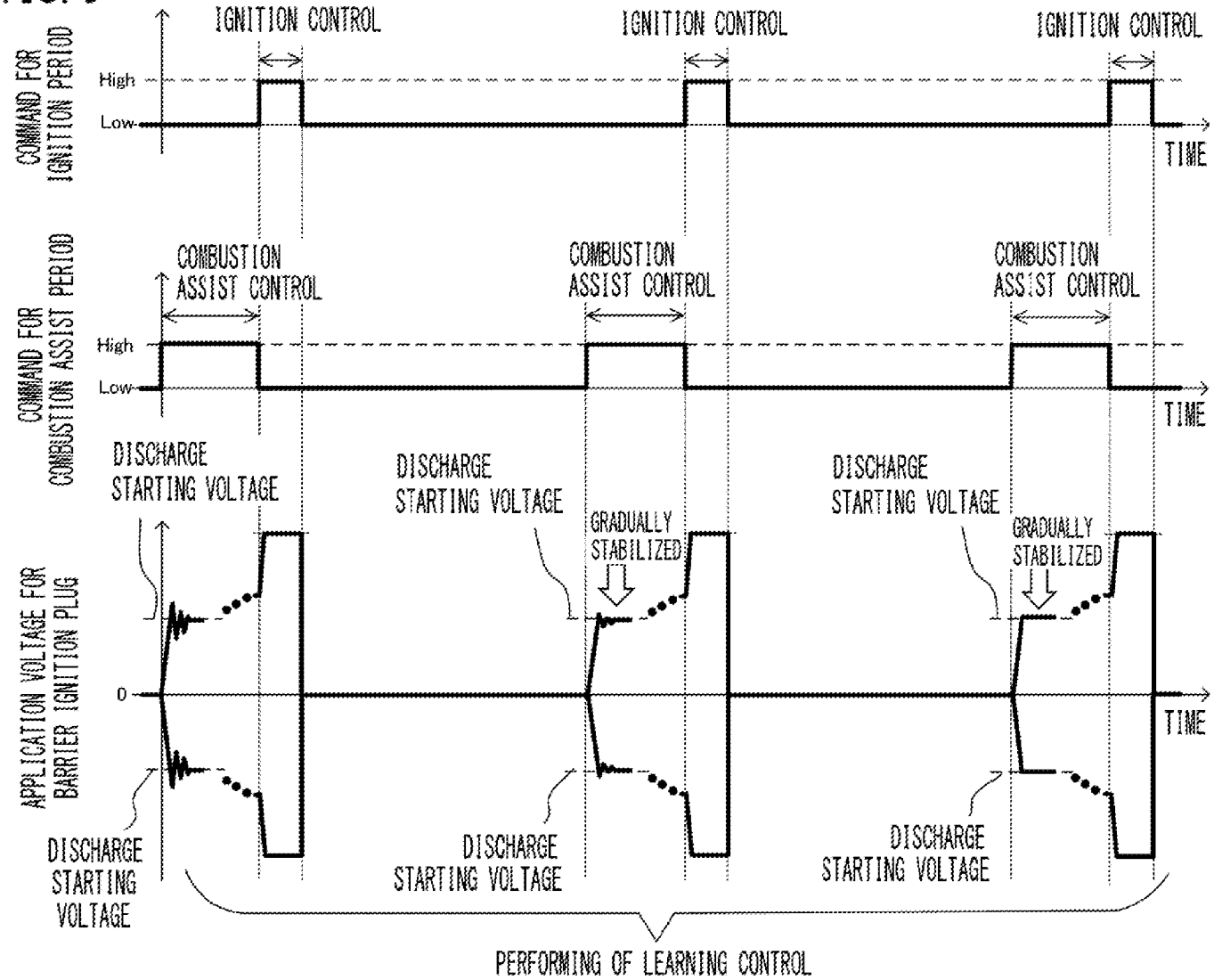
FIG. 9 is a timing chart for explaining the behavior of learning control according to Embodiment 1 of the present disclosure.
Figure 10:
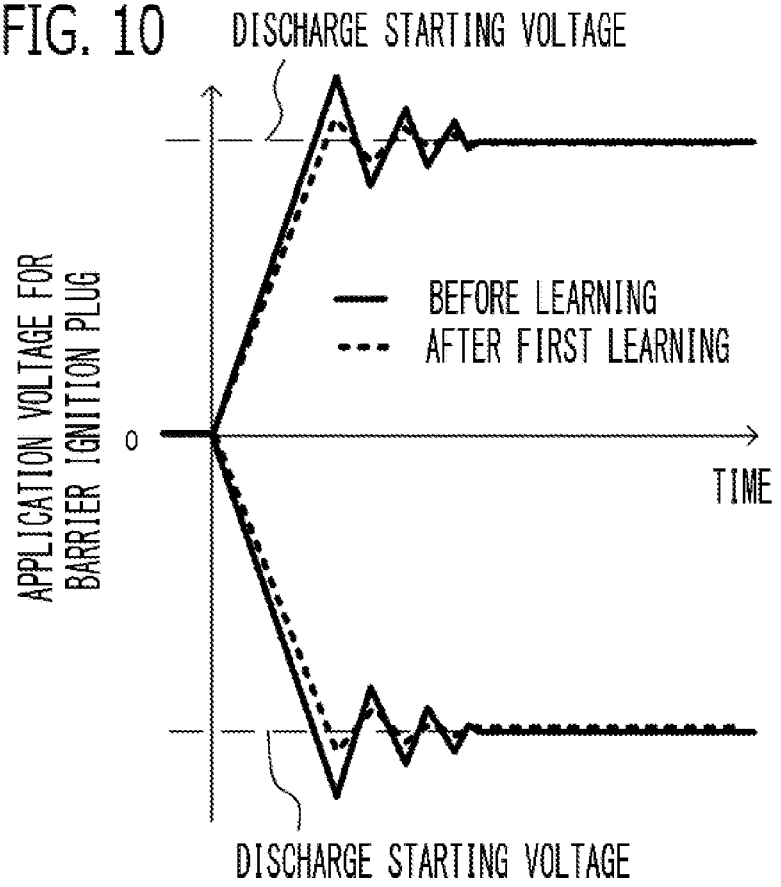
FIG. 10 is a timing chart for explaining the behavior of learning control according to Embodiment 1 of the present disclosure.

FIG. 9 represents the behavior of learning control of the command value. In FIG. 9, the abscissa denotes the time; the ordinate denotes the command for an ignition period, the command for a combustion assist period, and the application voltage for the barrier ignition plug 1. The application voltage is represented by a line connecting the maximum peak values of the application voltage and a line connecting the minimum peak values thereof in the AC period. FIG. 10 represents the respective expanded behaviors of the peak values of the application voltages at a time when the combustion assist control is implemented before learning has been performed and at a time when the combustion assist control is implemented after the first learning has been performed. In FIG. 9, when the first combustion assist control is implemented, the command value for the non-ignition discharge voltage has not been learned. Accordingly, the application voltage is oscillatory with respect to the discharge starting voltage. When the second combustion assist control is implemented, the oscillating components of the application voltage, with respect to the discharge starting voltage, decreases because the learning of the command value for the non-ignition discharge voltage has been performed once. When the third combustion assist control is implemented, the oscillating components of the application voltage, with respect to the discharge starting voltage, further decreases because the learning has been performed twice, and hence the behavior of the application voltage is stable.

As the learning method for the command value for the non-ignition discharge voltage, any learning method may be utilized as long as it decreases the voltage difference between the present discharge starting voltage and the command value for the non-ignition discharge voltage. For example, the control circuit 8 integrates each of the voltage differences by use of an integrator and sets a value, obtained by adding the integration value to the initial value of the command value for the non-ignition discharge voltage, to the next command value for the non-ignition discharge voltage. As the number of learning actions increases, the integration values converge at a fixed value. The application voltage can be made to keep track of the discharge starting voltage at high speed by performing such learning control; thus, the oscillation of the application voltage, due to a time delay caused by resonance growth or negative resonance growth, can be suppressed. Accordingly, for a change in the pressure inside the combustion chamber which is caused by a change in the operation state of the internal combustion engine, it is made possible to detect whether or not a discharge exists in a high-speed and stable manner, and also detect the discharge starting voltage in a high-speed and stable manner.

In this regard, however, although in the learning control in which each time the combustion assist control is implemented, the command value for the non-ignition discharge voltage is changed, it takes a considerable time until the command values converge at a fixed value, the learning control is readily applied to an internal combustion engine that is operated in a steady manner. However, contrivance is required when the learning control is applied to an internal combustion engine whose operation state rapidly changes. For example, because each time the operation state changes, the command value for the non-ignition discharge voltage changes, it may be allowed that an integration value is provided for each of the operation states and the integration values to be added to the respective command values are switched as the operation states change.

Setting of Command Value for Non-Ignition Discharge Voltage, Based on Discharge Starting Voltage Alternatively, it may be allowed that the foregoing learning control is not implemented. In other words, the control circuit 8 controls the frequency of the AC voltage outputted from the inverter 5, to the preliminarily set control frequency fc in the resonance frequency band; concurrently, the control circuit 8 raises the output AC voltage of the inverter 5 every AC period until it is determined that a discharge has started in the barrier ignition plug 1. Then, after it is determined that a discharge has started in the barrier ignition plug 1, the control circuit 8 increases or decreases the output AC voltage of the inverter 5 every AC period so that the application voltage approaches the discharge starting voltage determined at a time when it has been determined that the discharge started. In the present embodiment, the control circuit 8 increases or decreases the output DC voltage of the DC/DC converter 6 before the AC period so as to increase or decrease the output AC voltage of the inverter 5.

Figure 11:
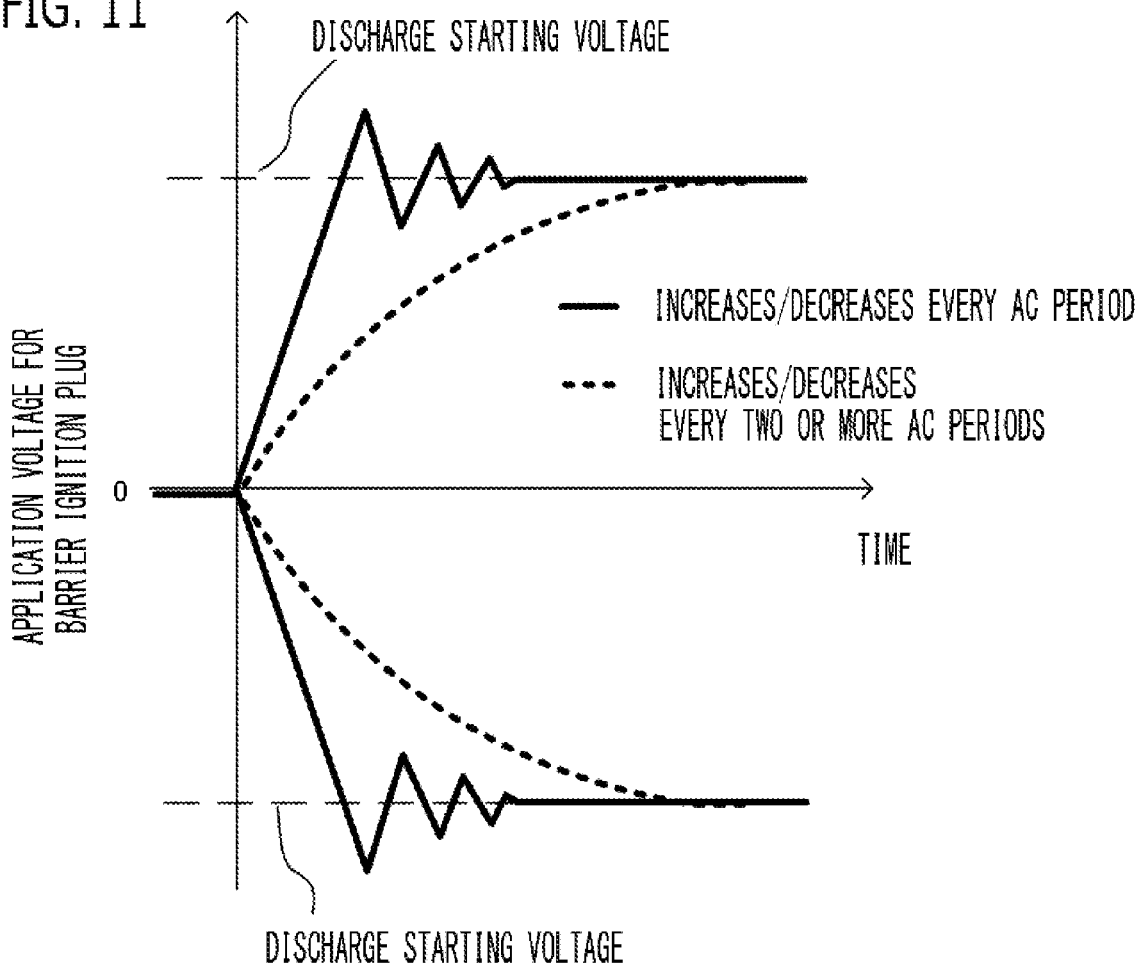
FIG. 11 is a timing chart for explaining the control method for an application voltage according to Embodiment 1 of the present disclosure.

In FIG. 11, the solid line represents the behavior of this control method. In FIG. 11, the abscissa denotes the time; the ordinate denotes the application voltage for the barrier ignition plug 1. The application voltage is represented by a line connecting the maximum peak values of the application voltage and a line connecting the minimum peak values thereof in the AC period. For a change in the pressure inside the combustion chamber which is caused by a change in the operation state of the internal combustion engine, this control method makes it possible to detect whether or not a discharge exists and the discharge starting voltage at high speed. In this regard, however, due to a time delay caused by resonance growth or negative resonance growth, the application voltage becomes oscillatory with respect to the discharge starting voltage. In particular, because after it is determined that a discharge has started, the application voltage overshoots the discharge starting voltage, a voltage higher than the discharge starting voltage is applied.

In order to suppress the application voltage from overshooting the discharge starting voltage, the control circuit 8 may be configured in the following manner. That is to say, the control circuit 8 may control the frequency of the AC voltage outputted from the inverter 5, to the preliminarily set control frequency fc in the resonance frequency band; and the control circuit 8 may raise the output AC voltage of the inverter 5 every two or more AC periods corresponding to the time delay caused by the resonance growth in the resonance circuit until it is determined that a discharge has started in the barrier ignition plug 1. Then, after it is determined that a discharge has started in the barrier ignition plug 1, the control circuit 8 may increase or decrease the output AC voltage of the inverter 5 every two or more AC periods so that the application voltage approaches the discharge starting voltage determined at a time when it has been determined that the discharge started. In the present embodiment, the control circuit 8 increases or decreases the output DC voltage of the DC/DC converter 6 before two or more AC periods so as to increase or decrease the output AC voltage of the inverter 5.

The duration of the two or more AC periods is set to a time delay from a time when the output AC voltage of the inverter 5 is increased in a stepped manner to a time when the change in the application voltage stabilizes. For example, the duration of the two or more AC periods is set to a time delay from a time when the output AC voltage of the inverter 5 is increased in a stepped manner to a time when the application voltage reaches 90% of the convergence value.

As the behavior of this control method represented by a dotted line in FIG. 11, it is made possible to suppress the application voltage from overshooting the discharge starting voltage. In this regard, however, because the starting timing of a discharge and the detection timing for the discharge starting voltage are delayed, it is desirable that this control method is utilized when no problem is posed regardless of the delay in these timings.

In either the case where the foregoing learning control is performed or the case where the learning control is not performed, the control circuit 8 may change the AC frequency of the inverter 5 every AC period or every two or more AC periods, as described above, instead of changing the output AC voltage of the inverter 5. In the case where the application voltage is raised, the AC frequency is made to approach the resonance frequency of the resonance circuit 3; in the case where the application voltage is lowered, the AC frequency is made to depart from the resonance frequency thereof.

Embodiment 2

Next, a barrier-discharge-type ignition apparatus according to Embodiment 2 will be explained. The explanation for constituent parts that are the same as those in Embodiment 1, described above, will be omitted. The basic configuration and processing of the barrier-discharge-type ignition apparatus according to Embodiment 2 are the same as those of the barrier-discharge-type ignition apparatus according to Embodiment 1; however, Embodiment 2 is different from Embodiment 1 in that in addition to the configuration of Embodiment 1, the controller 11 estimates the pressure inside the combustion chamber, based on the discharge starting voltage.

As explained with reference to FIG. 4 in Embodiment 1, in the compression stroke of the internal combustion engine, the discharge starting voltage increases as the pressure inside the combustion chamber increases. Therefore, based on the discharge starting voltage, the pressure inside the combustion chamber can be estimated. Moreover, as the pressure inside the combustion chamber increases, the ignition voltage required for ignition increases. Therefore, it is desirable that the ignition voltage is appropriately changed in accordance with the pressure inside the combustion chamber at a time immediately before the ignition timing.

Accordingly, in the present embodiment, the control circuit 8 refers to a relationship characteristic in which the relationship between the discharge starting voltage and the pressure inside the combustion chamber is preliminarily set, and then estimates the pressure inside the combustion chamber corresponding to the determined discharge starting voltage. Based on the estimated pressure inside the combustion chamber, the control circuit 8 calculates the command value for the ignition voltage, which is an application voltage required for ignition. Then, when the ignition control is implemented, the control circuit 8 raises the application voltage up to the command value for the ignition voltage.

The ignition-voltage application time required for stable combustion changes depending on the operation condition of the internal combustion engine. Therefore, based on the operation condition of the internal combustion engine, the control circuit 8 changes the ignition-voltage application time. For example, under an ignition-retardant condition such as that the pressure inside the combustion chamber is high, the control circuit 8 sets the application time to be longer than that under any of the other conditions. Under an ignition-facilitating condition such as that the temperature of the combustion chamber is high, the control circuit 8 sets the application time to be shorter than that under any of the other conditions. The control circuit 8 refers to a relationship characteristic in which the relationship between the ignition-voltage application time and the operation conditions of the internal combustion engine, such as the pressure inside the combustion chamber and the temperature of the combustion chamber, is preliminarily set, and then calculates the ignition-voltage application time corresponding to the estimated or detected operation condition. Then, during the application time, the control circuit 8 raises the application voltage up to the command value for the ignition voltage. The relationship characteristic of the application time is preliminarily set based on the result of an experiment and the like. This configuration makes it possible to raise the stability of combustion regardless of the operation condition and to reduce the ignition energy.

Figure 12:
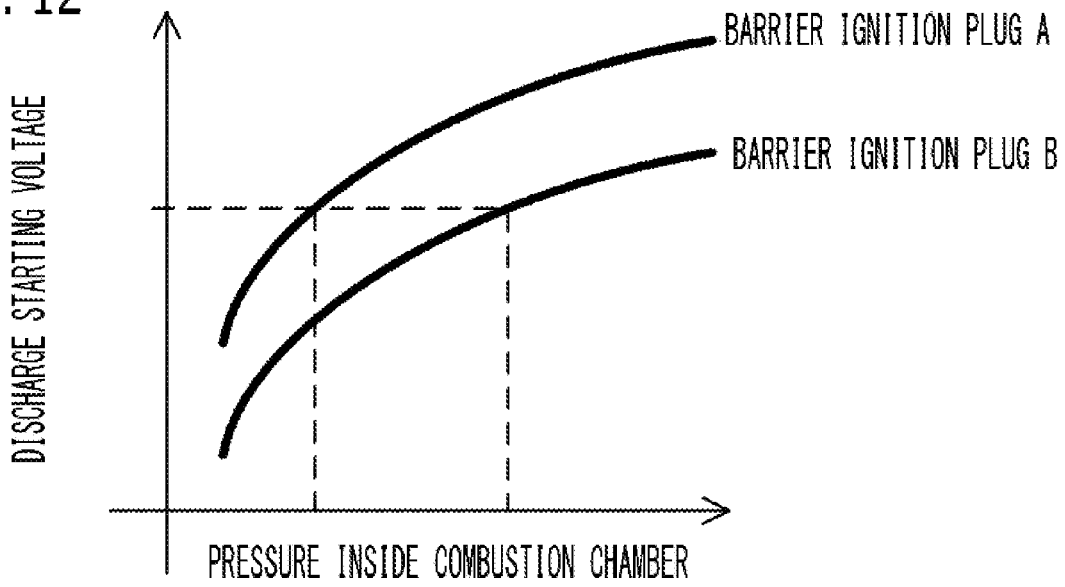
FIG. 12 is a characteristic chart for the relationship between the discharge start voltage and the pressure in a combustion chamber according to Embodiment 2 of the present disclosure.

FIG. 12 represents the relationship characteristic between the discharge starting voltage and the pressure inside the combustion chamber. In FIG. 12, the abscissa denotes the pressure inside the combustion chamber of the internal combustion engine; the ordinate denotes the discharge starting voltage for the barrier ignition plug 1. As the pressure inside the combustion chamber of the internal combustion engine rises, the discharge starting voltage increases. When the shape, the discharge gap, or the like of the barrier ignition plug 1 differs, the characteristic differs as those of the barrier ignition plug A and the barrier ignition plug B represented in FIG. 10 from each other. Accordingly, for each of the barrier ignition plugs, the relationship characteristic between the discharge starting voltage and the pressure inside the combustion chamber is preliminarily mapped in prior assessment, and then the map data is stored in the storage device of the control circuit 8. The map data may be stored in the storage device of ECU 9; alternatively, ECU 9 may estimate the pressure inside the combustion chamber, based on a combustion starting voltage transferred from the control circuit 8.

The control circuit 8 may calculate a critical value of the application voltage required for ignition, as the command value for the ignition voltage. For example, based on the estimated pressure inside the combustion chamber, the control circuit 8 calculates an ignition starting voltage, which is an application voltage at which ignition starts, and then sets the command value for the ignition voltage to a value obtained by adding a preliminarily set addition voltage to the ignition starting voltage. The addition voltage is set to be within a critical value of the voltage width so that even when a variation factor and a fluctuation factor occur, ignition is securely implemented. This configuration makes it possible to reduce the ignition energy by use of the determined discharge starting voltage.

The control circuit 8 refers to a relationship characteristic in which the relationship between the pressure inside the combustion chamber and the command value for the ignition voltage required for ignition or the command value for a critical value of the ignition voltage required for ignition is preliminarily set, and then calculates the command value for the ignition voltage corresponding to the estimated pressure inside the combustion chamber. For each of the barrier ignition plugs, the relationship characteristic between the command value for the ignition voltage and the pressure inside the combustion chamber is preliminarily mapped in prior assessment, and then the map data is stored in the storage device of the control circuit 8. The map data may be stored in the storage device of ECU 9; alternatively, ECU 9 may calculate the command value for the ignition voltage, based on the pressure inside the combustion chamber, and then may transfer the command value to the control circuit 8.

The voltage detection circuit 14 may detect the application voltage for the barrier ignition plug 1 at a time of ignition, and the control circuit 8 may refer to a relationship characteristic in which the relationship between the ignition voltage and the pressure inside the combustion chamber is preliminarily set and then estimates the pressure inside the combustion chamber corresponding to the application voltage at a time of ignition. Specifically, for each of the barrier ignition plugs, the relationship characteristic between the ignition voltage and the pressure inside the combustion chamber is preliminarily mapped in prior assessment, and then the map data is stored in the storage device of the control circuit 8. The map data may be stored in the storage device of ECU 9; alternatively, ECU 9 may estimate the pressure inside the combustion chamber, based on an application voltage at a time of ignition, transferred from the control circuit 8.

In the case where the estimation accuracy for the pressure inside the combustion chamber cannot be secured, the estimation value of the pressure inside the combustion chamber may be corrected with a predetermined correction value. A pressure sensor may be provided in the combustion chamber, and the control circuit 8 may detect the pressure inside the combustion chamber by use of the pressure sensor. Then, based on the pressure inside the combustion chamber estimated based on the discharge starting voltage or the application voltage at a time of ignition and based on the pressure inside the combustion chamber detected by the pressure sensor, the control circuit 8 may estimate the final pressure inside the combustion chamber. The detecting accuracy for the pressure inside the combustion chamber can be raised by combining the two pressure detection means. Furthermore, the control circuit 8 may calculate an average value of the pressure inside the combustion chamber in the period for estimating the pressure inside the combustion chamber and correct the average value of the pressure inside the combustion chamber by a predetermined correction value.

As described above, the pressure inside the combustion chamber at a time immediately before ignition can be obtained by estimating the pressure inside the combustion chamber; thus, it is made possible to perform ignition at a voltage required for the ignition or at a critical value of the voltage required for the ignition. Accordingly, even when the pressure inside the combustion chamber changes, ignition can securely be performed and the ignitability can be raised; in addition, the power consumption can be reduced and it is made possible to perform ignition with less abrasion of the barrier ignition plug 1.

Other Embodiments

Lastly, other embodiments of the present disclosure will be explained. Each of the configurations of embodiments to be explained below is not limited to be separately utilized but can be utilized in combination with the configurations of other embodiments as long as no discrepancy occurs.

(1) In each of the foregoing embodiments, as an example, there has been explained the case where the control circuit 8 increases or decreases the output DC voltage of the DC/DC converter 6 so as to increase or decrease the output AC voltage of the inverter 5. However, embodiments of the present disclosure are not limited to the foregoing case. That is to say, the control circuit 8 may increase or decrease the on-period (on-duty ratio) of the switching device in the inverter 5 so as to increase or decrease the output AC voltage of the inverter 5 for the output DC voltage of the DC/DC converter 6.

(2) In each of the foregoing embodiments, as an example, there has been explained the case where based on the application voltage detected by the voltage detection circuit 14, the control circuit 8 determines whether or not a discharge exists and the discharge starting voltage, and then calculates the command value for the non-ignition discharge voltage. However, embodiments of the present disclosure are not limited to the foregoing case. That is to say, based on the application voltage detected by the voltage detection circuit 14, ECU 9 may determine whether or not a discharge exists and the discharge starting voltage, calculate the command value for the non-ignition discharge voltage, and then transfer the command value for the non-ignition discharge voltage to the control circuit 8. The control circuit 8 and ECU 9 may share the processing function at an arbitrary sharing rate.

(3) In each of the foregoing embodiments, as an example, there has been explained the case where the controller 11 includes the control circuit 8 and ECU 9. However, the control circuit 8 may be incorporated in ECU 9, and the control circuit 8 and ECU 9 may be integrated with each other. Alternatively, it may be interpreted that the controller 11 is formed of the control circuit 8 that directly controls the DC/DC converter 6 and the inverter 5 and that the controller 11 does not include ECU 9.

The numeral values and the waveforms utilized in Embodiments 1 and 2 are only for explaining the embodiments and do not limit the scope of the present disclosure. In the scope of the present disclosure, the embodiments thereof can freely be combined with one another and can appropriately be modified or omitted.

REFERENCE SIGNS LIST

1 barrier ignition plug, 2 resonance coil, 3 resonance circuit, 4 transformer, 5 inverter, 6 DC/DC converter, 7 battery, 8 control circuit, 9 ECU (engine control unit), 10 power source circuit, 11 controller, 14 voltage detection circuit, VJH positive discharge determination threshold value, VJL negative discharge determination threshold value, α offset voltage, f1 resonance frequency of resonance circuit at a time when no discharge exists, fc control frequency

The invention claimed is:

1. A barrier-discharge-type ignition apparatus comprising:

a DC/DC converter that boosts a DC voltage and outputs the boosted DC voltage;

an inverter that inverts the DC voltage outputted from the DC/DC converter into an AC voltage and outputs the AC voltage;

a transformer that boosts the AC voltage outputted from the inverter and outputs the boosted AC voltage;

a resonance circuit that amplifies, by means of resonance, the AC voltage outputted from the transformer;

a barrier ignition plug to which the AC voltage amplified by the resonance circuit is applied, that is provided in a combustion chamber, and whose electrodes are covered with a dielectric;

a voltage detection circuit that detects an application voltage for the barrier ignition plug; and a controller that increases or decreases the application voltage for the barrier ignition plug by controlling the DC/DC converter and the inverter, wherein the controller performs combustion assist control that applies a non-ignition discharge voltage that causes a non-ignition discharge which is a discharge of the barrier ignition plug and does not lead to ignition of the fuel-air mixture, to the barrier ignition plug, in a combustion assist period which is a period set before ignition of a fuel-air mixture in the combustion chamber and for producing ozone and radicals and facilitating expansion of combustion at a time of ignition, and wherein in the combustion assist control, based on the application voltage detected by the voltage detection circuit, the controller calculates a voltage difference between the one-period-prior application voltage and the present-period application voltage in an AC period, and then determines whether or not the non-ignition discharge exists in the barrier ignition plug, based on a comparison between the voltage difference and a preliminarily set discharge determination threshold value, wherein in the combustion assist control, the controller controls a frequency of the output AC voltage of the inverter to a control frequency, which is a frequency within a resonance frequency band in which an AC voltage is amplified due to resonance in the resonance circuit and which is set to be the same as or higher than the resonance frequency of the resonance circuit at a time when no non-ignition discharge exists, wherein when the voltage difference obtained by subtracting the present-period application voltage from the one-period-prior application voltage is larger than a positive discharge determination threshold value which is set to a positive value, the controller determines that the non-ignition discharge has started in the barrier ignition plug, wherein when the voltage difference is smaller than a negative discharge determination threshold value which is set to a negative value, the controller determines that the non-ignition discharge in the barrier ignition plug has stopped, and wherein when the voltage difference is between the positive discharge determination threshold value and the negative discharge determination threshold value, the controller determines that the state of whether or not the non-ignition discharge exists in the barrier ignition plug, which has been determined at the immediately previous time, is being maintained.

2. The barrier-discharge-type ignition apparatus according to claim 1, wherein based on the application voltage at a time when it is determined that the non-ignition discharge has started in the barrier ignition plug, the controller determines a discharge starting voltage, which is the application voltage at which the non-ignition discharge starts in the barrier ignition plug.

3. The barrier-discharge-type ignition apparatus according to claim 1, wherein the controller changes the discharge determination threshold value in accordance with a PD product calculated by multiplying a pressure inside the combustion chamber by a discharge gap.

4. The barrier-discharge-type ignition apparatus according to claim 1, wherein based on the application voltage at a time when it is determined that the non-ignition discharge has started in the barrier ignition plug, the controller determines a discharge starting voltage, which is the application voltage at which the non-ignition discharge starts in the barrier ignition plug, and wherein the controller changes a command value for the non-ignition discharge voltage to be applied to the barrier ignition plug, based on the determined discharge starting voltage.

5. A barrier-discharge-type ignition apparatus comprising:

a DC/DC converter that boosts a DC voltage and outputs the boosted DC voltage;

an inverter that inverts the DC voltage outputted from the DC/DC converter into an AC voltage and outputs the AC voltage;

a transformer that boosts the AC voltage outputted from the inverter and outputs the boosted AC voltage;

a resonance circuit that amplifies, by means of resonance, the AC voltage outputted from the transformer;

a barrier ignition plug to which the AC voltage amplified by the resonance circuit is applied, that is provided in a combustion chamber, and whose electrodes are covered with a dielectric;

a voltage detection circuit that detects an application voltage for the barrier ignition plug: and a controller that increases or decreases the application voltage for the barrier ignition plug by controlling the DC/DC converter and the inverter, wherein the controller performs combustion assist control that applies a non-ignition discharge voltage that causes a non-ignition discharge which is a discharge of the barrier ignition plug and does not lead to ignition of the fuel-air mixture, to the barrier ignition plug, in a combustion assist period which is a period set before ignition of a fuel-air mixture in the combustion chamber and for producing ozone and radicals and facilitating expansion of combustion at a time of ignition, and wherein in the combustion assist control, based on the application voltage detected by the voltage detection circuit, the controller calculates a voltage difference between the one-period-prior application voltage and the present-period application voltage in an AC period, and then determines whether or not the non-ignition discharge exists in the barrier ignition plug, based on a comparison between the voltage difference and a preliminarily set discharge determination threshold value, wherein based on the application voltage at a time when it is determined that the non-ignition discharge has started in the barrier ignition plug, the controller determines a discharge starting voltage, which is the application voltage at which the non-ignition discharge starts in the barrier ignition plug, and wherein the controller changes a command value for the non-ignition discharge voltage to be applied to the barrier ignition plug to a voltage obtained by adding a preliminarily set offset voltage to the determined discharge starting voltage.

6. A barrier-discharge-type ignition apparatus comprising:

a DC/DC converter that boosts a DC voltage and outputs the boosted DC voltage;

an inverter that inverts the DC voltage outputted from the DC/DC converter into an AC voltage and outputs the AC voltage;

a transformer that boosts the AC voltage outputted from the inverter and outputs the boosted AC voltage;

a resonance circuit that amplifies, by means of resonance, the AC voltage outputted from the transformer;

a barrier ignition plug to which the AC voltage amplified by the resonance circuit is applied, that is provided in a combustion chamber, and whose electrodes are covered with a dielectric;

a voltage detection circuit that detects an application voltage for the barrier ignition plug; and a controller that increases or decreases the application voltage for the barrier ignition plug by controlling the DC/DC converter and the inverter, wherein the controller performs combustion assist control that applies a non-ignition discharge voltage that causes a non-ignition discharge which is a discharge of the barrier ignition plug and does not lead to ignition of the fuel-air mixture, to the barrier ignition plug, in a combustion assist period which is a period set before ignition of a fuel-air mixture in the combustion chamber and for producing ozone and radicals and facilitating expansion of combustion at a time of ignition, and wherein in the combustion assist control, based on the application voltage detected by the voltage detection circuit, the controller calculates a voltage difference between the one-period-prior application voltage and the present-period application voltage in an AC period, and then determines whether or not the non-ignition discharge exists in the barrier ignition plug, based on a comparison between the voltage difference and a preliminarily set discharge determination threshold value, wherein based on the application voltage at a time when it is determined that the non-ignition discharge has started in the barrier ignition plug, the controller determines a discharge starting voltage, which is the application voltage at which the non-ignition discharge starts in the barrier ignition plug, and wherein after the combustion assist control has been started, the controller controls a frequency of the AC voltage outputted from the inverter to a control frequency, which is preliminarily set within the resonance frequency band in which the AC voltage is amplified due to resonance in the resonance circuit; and, the controller raises the output AC voltage of the inverter until it is determined that the non-ignition discharge has started in the barrier ignition plug, wherein after it is determined that the non-ignition discharge has started in the barrier ignition plug, the controller increases or decreases the output AC voltage of the inverter so that the application voltage approaches a command value for the non-ignition discharge voltage, and wherein the controller performs learning control of changing the command value for the non-ignition discharge voltage, which is utilized next time, so that the voltage difference between the discharge starting voltage determined this time and the non-ignition discharge voltage utilized this time decreases.

7. A barrier-discharge-type ignition apparatus comprising:

a DC/DC converter that boosts a DC voltage and outputs the boosted DC voltage;

an inverter that inverts the DC voltage outputted from the DC/DC converter into an AC voltage and outputs the AC voltage;

a transformer that boosts the AC voltage outputted from the inverter and outputs the boosted AC voltage;

a resonance circuit that amplifies, by means of resonance, the AC voltage outputted from the transformer;

a barrier ignition plug to which the AC voltage amplified by the resonance circuit is applied, that is provided in a combustion chamber, and whose electrodes are covered with a dielectric;

a voltage detection circuit that detects an application voltage for the barrier ignition plug; and a controller that increases or decreases the application voltage for the barrier ignition plug by controlling the DC/DC converter and the inverter, wherein the controller performs combustion assist control that applies a non-ignition discharge voltage that causes a non-ignition discharge which is a discharge of the barrier ignition plug and does not lead to ignition of the fuel-air mixture, to the barrier ignition plug, in a combustion assist period which is a period set before ignition of a fuel-air mixture in the combustion chamber and for producing ozone and radicals and facilitating expansion of combustion at a time of ignition, and wherein in the combustion assist control, based on the application voltage detected by the voltage detection circuit, the controller calculates a voltage difference between the one-period-prior application voltage and the present-period application voltage in an AC period, and then determines whether or not the non-ignition discharge exists in the barrier ignition plug, based on a comparison between the voltage difference and a preliminarily set discharge determination threshold value, wherein based on the application voltage at a time when it is determined that the non-ignition discharge has started in the barrier ignition plug, the controller determines a discharge starting voltage, which is the application voltage at which the non-ignition discharge starts in the barrier ignition plug, wherein after the combustion assist control has been started, the controller controls a frequency of the AC voltage outputted from the inverter to a control frequency, which is preliminarily set within the resonance frequency band in which the AC voltage is amplified due to resonance in the resonance circuit; and, the controller raises the output AC voltage of the inverter every AC period until it is determined that the non-ignition discharge has started in the barrier ignition plug, and wherein after it is determined that the non-ignition discharge has started in the barrier ignition plug, the controller increases or decreases the output AC voltage of the inverter every AC period so that the application voltage approaches the discharge starting voltage determined at a time when it has been determined that the non-ignition discharge started.

8. A barrier-discharge-type ignition apparatus comprising:

a DC/DC converter that boosts a DC voltage and outputs the boosted DC voltage;

an inverter that inverts the DC voltage outputted from the DC/DC converter into an AC voltage and outputs the AC voltage;

a transformer that boosts the AC voltage outputted from the inverter and outputs the boosted AC voltage;

a resonance circuit that amplifies, by means of resonance, the AC voltage outputted from the transformer;

a barrier ignition plug to which the AC voltage amplified by the resonance circuit is applied, that is provided in a combustion chamber, and whose electrodes are covered with a dielectric;

a voltage detection circuit that detects an application voltage for the barrier ignition plug; and a controller that increases or decreases the application voltage for the barrier ignition plug by controlling the DC/DC converter and the inverter, wherein the controller performs combustion assist control that applies a non-ignition discharge voltage that causes a non-ignition discharge which is a discharge of the barrier ignition plug and does not lead to ignition of the fuel-air mixture, to the barrier ignition plug, in a combustion assist period which is a period set before ignition of a fuel-air mixture in the combustion chamber and for producing ozone and radicals and facilitating expansion of combustion at a time of ignition, and wherein in the combustion assist control, based on the application voltage detected by the voltage detection circuit, the controller calculates a voltage difference between the one-period-prior application voltage and the present-period application voltage in an AC period, and then determines whether or not the non-ignition discharge exists in the barrier ignition plug, based on a comparison between the voltage difference and a preliminarily set discharge determination threshold value, wherein based on the application voltage at a time when it is determined that the non-ignition discharge has started in the barrier ignition plug, the controller determines a discharge starting voltage, which is the application voltage at which the non-ignition discharge starts in the barrier ignition plug, wherein after the combustion assist control has been started, the controller controls a frequency of the AC voltage outputted from the inverter to a control frequency, which is preliminarily set within the resonance frequency band in which the AC voltage is amplified due to resonance in the resonance circuit; and, the controller raises the output AC voltage of the inverter every two or more AC periods corresponding to a time delay caused by resonance grow in the resonance circuit until it is determined that the non-ignition discharge has started in the barrier ignition plug, and wherein after it is determined that the non-ignition discharge has started in the barrier ignition plug, the controller increases or decreases the output AC voltage of the inverter every the two or more AC periods so that the application voltage approaches the discharge starting voltage determined at a time when it has been determined that the non-ignition discharge started.

9. A barrier-discharge-type ignition apparatus comprising:

a DC/DC converter that boosts a DC voltage and outputs the boosted DC voltage:

an inverter that inverts the DC voltage outputted from the DC/DC converter into an AC voltage and outputs the AC voltage;

a transformer that boosts the AC voltage outputted from the inverter and outputs the boosted AC voltage;

a resonance circuit that amplifies, by means of resonance, the AC voltage outputted from the transformer;

a barrier ignition plug to which the AC voltage amplified by the resonance circuit is applied, that is provided in a combustion chamber, and whose electrodes are covered with a dielectric;

a voltage detection circuit that detects an application voltage for the barrier ignition plug; and a controller that increases or decreases the application voltage for the barrier ignition plug by controlling the DC/DC converter and the inverter, wherein the controller performs combustion assist control that applies a non-ignition discharge voltage that causes a non-ignition discharge which is a discharge of the barrier ignition plug and does not lead to ignition of the fuel-air mixture, to the barrier ignition plug, in a combustion assist period which is a period set before ignition of a fuel-air mixture in the combustion chamber and for producing ozone and radicals and facilitating expansion of combustion at a time of ignition, and wherein in the combustion assist control, based on the application voltage detected by the voltage detection circuit, the controller calculates a voltage difference between the one-period-prior application voltage and the present-period application voltage in an AC period, and then determines whether or not the non-ignition discharge exists in the barrier ignition plug, based on a comparison between the voltage difference and a preliminarily set discharge determination threshold value, wherein based on the application voltage at a time when it is determined that the non-ignition discharge has started in the barrier ignition plug, the controller determines a discharge starting voltage, which is the application voltage at which the non-ignition discharge starts in the barrier ignition plug, and wherein the controller refers to a relationship characteristic in which the relationship between the discharge starting voltage and the pressure inside the combustion chamber is preliminarily set, and estimates the pressure inside the combustion chamber corresponding to the determined discharge starting voltage; based on the estimated pressure inside the combustion chamber, the controller calculates a command value for the ignition voltage, which is the application voltage required for ignition; then, when ignition control is implemented, the controller raises the application voltage up to the command value for the ignition voltage.

10. The barrier-discharge-type ignition apparatus according to claim 9, wherein the controller calculates a critical value of the application voltage required for ignition, as the command value for the ignition voltage.

11. The barrier-discharge-type ignition apparatus according to claim 9, further comprising a pressure sensor in the combustion chamber, wherein based on the pressure inside the combustion chamber estimated based on the discharge starting voltage and the pressure inside the combustion chamber detected by the pressure sensor, the controller estimates the final pressure inside the combustion chamber.

* * * * *